US005975042A

United States Patent [19]

Aizawa et al.

[11] Patent Number: 5,975,042

[45] Date of Patent: Nov. 2, 1999

[54] OIL SUPPLY APPARATUS OF A FOUR-STROKE-CYCLE ENGINE

[75] Inventors: Shigemitsu Aizawa; Toshio Hirabayashi; Masatomi Nijoh, all of Nagano, Japan

[73] Assignee: Ishiakawjima-Shibaura Machinery Co., Ltd., Tokyo, Japan

[21] Appl. No.: 09/105,202

[22] Filed: Jun. 26, 1998

[30] Foreign Application Priority Data

| | | | |
|---|---|---|---|
| Jun. 26, 1997 | [JP] | Japan | 9-169334 |
| Sep. 11, 1997 | [JP] | Japan | 9-246336 |
| Mar. 27, 1998 | [JP] | Japan | 10-82040 |

[51] Int. Cl.[6] ..... F01M 1/00

[52] U.S. Cl. ..... 123/196 M; 123/196 R; 123/196 CP; 123/196 M; 184/6.2; 184/6.5

[58] Field of Search ..... 123/196 R, 196 CP, 123/196 W, 196 M, 196 V, 196 S; 184/6.5, 6.2, 6.9, 6.26; 222/464.3, 464.4; 137/38, 44, 577, 592

[56] References Cited

U.S. PATENT DOCUMENTS

| | | | |
|---|---|---|---|
| 158,926 | 2/1875 | Claudel | 254/209 |
| 1,311,148 | 7/1919 | Burns | 123/74 AA |
| 1,871,055 | 8/1932 | Hasbrouck | 244/135 R |
| 2,011,833 | 8/1935 | Sorg | 123/196 M |
| 3,627,078 | 12/1971 | Burrous . | |
| 4,108,135 | 8/1978 | Kubis | 123/196 R |
| 4,601,267 | 7/1986 | Kronich . | |
| 4,794,896 | 1/1989 | Tsai et al. . | |
| 4,830,235 | 5/1989 | Miller | 222/464.4 |
| 4,940,152 | 7/1990 | Lin | 215/11.5 |
| 5,195,664 | 3/1993 | Rhea | 222/464.4 |
| 5,582,145 | 12/1996 | Aizawa et al. | 123/196 CP |
| 5,606,944 | 3/1997 | Kurihara | 123/90.31 |
| 5,709,185 | 1/1998 | Aizawa et al. . | |
| 5,755,194 | 5/1998 | Moorman et al. . | |

FOREIGN PATENT DOCUMENTS

| | | |
|---|---|---|
| 0 779 412 | 6/1997 | European Pat. Off. . |
| 0 835 987 | 4/1998 | European Pat. Off. . |
| 529 373 | 11/1921 | France . |
| 2 597 546 | 10/1987 | France . |
| 4-93707 | 8/1992 | Japan . |
| 8-260926 | 10/1996 | Japan . |
| 9-228816 | 9/1997 | Japan . |

*Primary Examiner*—Henry C. Yuen
*Assistant Examiner*—Hai Huynh
*Attorney, Agent, or Firm*—Oblon, Spivak, McClelland, Maier & Neustadt, P.C.

[57] ABSTRACT

An oil supply passage is provided for connecting an oil chamber with a valve chamber, an oil feed passage for connecting a valve chamber with a crank chamber, and an oil return passage for connecting the crank chamber with the oil chamber. The oil return passage is connected with the crank chamber via a plurality of return vents formed on an inner surface of the crank chamber at approximately equal intervals. Providing a bypass passage, one end of the bypass passage opens adjacent to a ceiling of the valve chamber. Another end of the bypass passage opens into a portion facing the restrictor formed adjacent to an outlet of the oil feed passage. Accordingly, the crank chamber and the valve chamber are lubricated by pressure fluctuations of the crank chamber according to the reciprocation of a piston. Thus, it is possible to lubricate the engine even when the engine is tilted in any direction.

18 Claims, 17 Drawing Sheets

OIL SUPPLY APPARATUS OF A FOUR-STROKE-CYCLE ENGINE

BACKGROUND OF THE INVENTION

1. Field of the Invention

The present invention relates to an oil supply apparatus of a four-stroke-cycle engine for use mainly on a portable work machine.

2. Discussion of the Background

A portable work machine such as a chain saw, a lawn mower or a mower is generally mounted with a two-stroke-cycle engine since this type of engine has advantages such as a simple structure and light weight. The two-stroke-cycle engine, however, has disadvantages in that there are large amounts of CO, HC in exhaust gases thereof. This is a problem for cleaning engine exhaust gases and environmental protection.

A four-stroke-cycle engine has advantages with respect to avoiding air pollution since the amount of CO, HC of this type of engine is small compared with the two-stroke-cycle engine. Recently, therefore, investigations have been conducted on the mounting of the four-stroke-cycle engine on the portable work machine such as the chain saw, the lawn mower and the mower.

The portable work machine, such as the chain saw and the mower, is tilted in various directions during operation, so that the engine mounted on the portable work machine is also tilted in various directions. Thus, the engine mounted on the portable work machine pitches and rolls during operation. Such slants of the engine are not serious for the two-stroke-cycle engine. It is, however, serious for the four-stroke-cycle engine. This is because oil can not be supplied to several parts of the engine if the four-stroke-cycle engine is tilted. More specifically, an oil surface of an oil reservoir fluctuates according to slants of the engine. Then, an oil inlet of an inlet pipe, which inhaled or sucked the oil from the oil reservoir, rises above the oil surface. Thus, the oil can not be supplied to several parts of the engine. Considering this disadvantage, a four-stroke-cycle engine adapted to be mounted on the portable work machine has been developed. Such a four-stroke-cycle engine is disclosed in Japanese Utility Model Laid-Open No. Hei 4-93707, Japanese Patent Laid-Open No. Hei 8-260926 and Japanese Patent Laid-Open No. Hei 9-228816.

Japanese Utility Model Laid-Open No. Hei 4-93707 discloses a four-stroke-cycle engine having an oil pan with a contrivance. According to the contrivance of the oil pan, oil leakage from the oil pan does not occur if the four-stroke-cycle engine is tilted within a certain range. This four-stroke-cycle engine has a splash type oil supply system, which splashes the oil by an oil dipper provided with a connecting rod. The four-stroke-cycle engine disclosed in Japanese Utility Model Laid-Open No. Hei 4-93707, however, has a disadvantage in that big oil leakage from a blowby gas exhaust passage occurs in the inverted position of the engine. Also, a piston and a crank shaft would be soaked in oil in the inverted position of the engine. When the piston and the crank shaft are soaked in the oil, the power of the four-stroke-cycle engine is seriously decreased due to resistance of the oil. It is, therefore, difficult to use the portable work machine in a position that inverts the four-stroke-cycle engine.

A four-stroke-cycle engine disclosed in Japanese Patent Laid-Open No. Hei 8-260926 circulates the oil through a crank chamber, an oil chamber and a valve chamber using pressure fluctuation of the crank chamber caused by reciprocation of a piston. It is, however, not capable of returning the oil from the crank chamber to the oil chamber and from the valve chamber to the crank chamber when the four-stroke-cycle engine is inverted. It is, therefore, difficult to use the portable work machine for a long period of time in the position that inverts the four-stroke-cycle engine.

Japanese Patent Laid-Open No. Hei 9-228816 discloses an invention of an oil supply apparatus of a four-stroke-cycle engine for inhaling the oil compulsively from an oil reservoir in an oil tank by an oil pump. The oil supply apparatus comprising: an inhaling pipe for inhaling the oil from the oil reservoir, the inhaling pipe having an oil inhaling inlet rotatably supported around a crank shaft of the engine and a perpendicular axis of the crank shaft, and a weight attached to the inhaling pipe adjacent to the oil inhaling inlet, wherein the oil inhaling inlet is always urged to the direction of the gravity by the weight. It is, however, necessary to provide a mechanism for rotating the oil inhaling inlet in two directions and a sealing mechanism for supporting the rotating mechanism airtightly in an oil pan, for the oil supply apparatus. Thus, the oil supply apparatus has several disadvantages such as a complex structure, increasing the number of parts, the large sizing of the apparatus, and increasing of weight. Especially, the large sizing of the apparatus and the weight increase are serious for a portable work machine mounted with the four-stroke-cycle engine since a load imposed on an operator will increase.

Further, in general, a four-stroke-cycle engine has a disadvantage in that too much oil is supplied when the liquid oil is supplied directly to inside of the engine such as to the crank chamber and the valve chamber. In this case, excessive oil gives resistance to smooth rotation and slide movement of the rotating parts and sliding parts, then, engine power will be less. Thus, a four-stroke-cycle engine that supplies the oil in mist condition to the inside of the engine is originated. For example, Japanese Patent Laid-Open No. Hei 9-228816 discloses such a four-stroke-cycle engine. This engine comprising: a crank shaft disposed in an oil tank, and an oil slinger fixed to the crank shaft, wherein whipping of the oil according to rotation of the oil slinger in the oil tank, then, the oil in the mist condition is generated.

However, the four-stroke-cycle engine disclosed in Japanese Patent Laid-Open No. Hei 9-228816 has the following disadvantages. Great resistance is given to the oil slinger when the oil slinger whips the oil. Thus, the engine power will be less due to the resistance of the oil slinger. Since the oil tank and the crank case should be formed side by side, the size of the engine along the crank shaft will be increase, then, the size of the engine itself will be increased.

SUMMARY OF THE INVENTION

It is an object of the present invention to provide an oil supply apparatus of a four-stroke-cycle engine in which the oil can be supplied surely to a crank chamber and a valve chamber without excessive supply of the oil even when the engine is tilted in any direction.

It is another object of the present invention to provide the oil supply apparatus of the four-stroke-cycle engine in which the oil can be supplied surely from an oil tank to several parts of the engine with a simple structure even when the engine is tilted any direction.

It is another object of the present invention to provide the oil supply apparatus of the four-stroke-cycle engine in which the oil can be supplied surely from the oil tank to several parts of the engine without increasing the number of parts even when the engine is tilted in any direction.

It is another object of the present invention to provide the oil supply apparatus of the four-stroke-cycle engine in which the oil can be supplied surely from the oil tank to several parts of the engine having small size even when the engine is tilted in any direction.

It is another object of the present invention to provide the oil supply apparatus of the four-stroke-cycle engine in which the oil can be supplied surely from the oil tank to several parts of the engine having light weight even when the engine is tilted in any direction.

It is a further object of the present invention to provide the oil supply apparatus of the four-stroke-cycle engine in which the oil can be supplied surely from the oil tank to several parts of the engine with reliability even when the engine is tilted any direction.

It is another object of the present invention to provide the oil supply apparatus of the four-stroke-cycle engine in which the oil in a mist condition can be supplied from the oil tank to inner parts of the engine such as the crank chamber and the valve chamber without decreasing power of the engine.

It is another object of the present invention to provide the oil supply apparatus of the four-stroke-cycle engine which is capable of realizing a small-size and light-weight of the engine.

It is a further object of the present invention to provide the oil supply apparatus of the four-stroke-cycle engine which is capable of warming the oil up quickly and lubricating several parts of the engine well at the time of initial starting and low temperature starting of the engine.

The present invention provides the oil supply apparatus of the four-stroke-cycle engine. This oil supply apparatus comprising:

an oil tank for holding oil;

a crank case for forming a crank chamber, inside pressure of the crank chamber fluctuates according to movement of a piston;

a valve chamber for holding a valve mechanism;

an oil supply passage for connecting an inside of the oil tank with the valve chamber;

an oil feed passage for connecting the valve chamber with the crank chamber;

a return passage for connecting the crank chamber with the inside of the oil tank via a plurality of return vents formed on an inner surface of the crank chamber at approximately equal intervals;

a first check valve disposed at the oil feed passage for allowing feed oil to pass from the valve chamber to the crank chamber;

a second check valve disposed at the return passage for allowing feed oil to pass from the crank chamber to the oil tank;

a restrictor formed in the oil feed passage adjacent to a vent connecting with the crank chamber; and a bypass passage for connecting the valve chamber with the oil feed passage, one end of the bypass passage opens into the valve chamber adjacent to ceiling of the valve chamber, another end of the bypass passage opens into a portion facing to the restrictor.

At the time of operation of the four-stroke-cycle engine, the first check valve is opened when the negative pressure builds up in the crank chamber according to an upward stroke of the piston. Then, the oil in the valve chamber is fed to the crank chamber via the oil feed passage.

The second check valve is opened when the positive pressure builds up in the crank chamber according to a downward stroke of the piston. Then, the oil in the crank chamber returns to the oil tank via the return passage. At the same time, the oil in the oil tank supplies to the valve chamber via the oil supply passage. The oil, therefore, circulates through the oil tank, the valve chamber, the crank chamber and the oil tank using a pressure fluctuation of the crank chamber according to a reciprocation of the piston. Thus, a valve mechanism held in the valve chamber and a crank shaft and some gears held in the crank chamber are lubricated.

Since the plurality of return vents are formed on an inner surface of the crank chamber at approximately equal intervals and the return vents connect the return passage with the crank chamber, the oil in the crank chamber is fed to the return passage via the lowest return vent, the oil in mist condition is fed to the return passage via other return vents, then the oil will return to the oil tank via the return passage, even when the four-stroke-cycle engine is tilted in any direction. The oil, therefore, returns to the oil tank smoothly even when the four-stroke-cycle engine is tilted in any direction. Thus, it prevents too much oil from remaining in the crank chamber.

When the negative pressure builds up in the crank chamber according to a downward stroke of the piston, the oil in the valve chamber is inhaled into the crank chamber with gases in the valve chamber via the oil feed passage, velocity of the gases becomes high at the restrictor, then, a big negative pressure is built around the restrictor. Thus, the structure of the bypass passage, i.e., one end of the bypass passage opens into the valve chamber adjacent to the ceiling of the valve chamber and another end of the bypass passage opens into a portion facing the restrictor, which allows the oil remaining in the ceiling of the valve chamber to be inhaled into the crank chamber via the bypass passage when the engine operates upside down. Accordingly, the scenario can be prevented where excessive oil remains in the valve chamber when the engine operates upside down.

The other aspect of the present invention provides the oil supply apparatus of a four-stroke-cycle engine. This oil supply apparatus comprising:

an oil chamber for holding oil;

an oil supply passage for connecting the oil chamber with an inside of the engine, inside pressure of the engine fluctuates according to movement of a piston, the oil supply passage supplies oil from the oil chamber to the inside of the engine according to pressure fluctuation of the inside of the engine;

an oil return passage for connecting the oil chamber with the inside of the engine, the oil return passage returns oil from the inside of the engine from the oil chamber according to pressure fluctuation of the inside of the engine;

an air inhalation vent provided in the oil supply passage and disposed at a center of the oil chamber;

a return vent provided in the return passage and disposed at the center of the oil chamber;

a restrictor formed in the oil supply passage for restricting air flow from the air inhalation vent; and an oil inhalation passage providing an oil inlet disposed at a bottom of the oil chamber and an oil outlet at a portion facing to the restrictor.

When the negative pressure is built up in the engine according to a reciprocation of the piston, the oil in mist condition is supplied into inner parts of the engine via the oil supply passage and the oil in mist condition lubricates the inner parts of the engine such as rotating parts and sliding parts.

When the positive pressure is built up in the engine according to the reciprocation of the piston, the oil in the engine is fed into the oil chamber with air via the return passage and returns into the oil chamber by blowing up from the return vent. At the same time, the oil in the oil chamber is blown into the oil supply passage from the outlet of the oil inhalation passage via the oil inhalation passage, and the air in the oil chamber is inhaled into the oil supply passage from the air inhalation vent. Since the velocity of the air inhaled from the air inhalation vent becomes high at the restrictor, blowing up the oil from the oil outlet of the oil inhalation passage is hastened. Thus, the oil and the air are mixed, then, the oil in the mist condition is generated.

The air inhalation vent is arranged at a center of the oil chamber. Thus, under the condition, which limits the oil quantity less than a certain quantity, the air inhalation vent is not soaked in the oil held in the oil tank and the oil in the mist condition can be supplied into the engine surely even though the engine is tilted in any direction.

The return vent is also arranged at the center of the oil chamber. Thus, under the condition, which limits the oil quantity to less than a certain quantity, then the return vent is not soaked in the oil held in the oil tank even though the engine is tilted in any direction. It is, therefore, prevented that the air flowing in the oil return passage with the oil mixes into the oil and whips a surface of the oil. Consequently, a mist density of the oil supplied into the engine is kept constant.

Here, "the bottom of the oil chamber" does not mean a certain portion of an inner surface of the oil chamber. It means a lowest point in the direction of gravity with respect to the inner surface of the oil chamber. Thus, the bottom of the oil chamber will be changed in accordance with an inclination of the engine. The oil is, therefore, always filled up or located in the bottom of the oil chamber.

The other aspect of the present invention provides the oil supply apparatus of the four-stroke-cycle engine. This oil supply apparatus comprising:

an oil chamber for holding oil;

an oil inlet passage comprising: an oil inlet pipe rotatably supported in the oil chamber; and an elastic pipe formed by elastic materials and connected with the oil inlet pipe, the oil inlet pipe has an oil inlet at one end soaked into the oil held in the oil chamber;

a weight attached to the oil inlet passage adjacent to the oil inlet; and an oil supply means connected with the oil inlet pipe for supplying oil to inner parts of the engine from the oil chamber via the oil inlet.

The oil supply means feeds the oil from the oil chamber via the oil inlet of the oil supply passage and supplies the oil to inner parts of the four-stroke cycle engine. Thus, the inner parts of the engine are lubricated. When the engine mounted with a portable work machine is tilted, since the oil inlet pipe is rotatably supported and one end of the oil inlet passage comprising the elastic pipe formed by elastic material, the oil inlet pipe rotates and the elastic pipe is weighed down so that the oil inlet is always positioned so as to face the direction of gravity. Thus, the oil inlet is always soaked in the oil held in the oil chamber. The oil held in the oil chamber, therefore, can be supplied surely to inner parts of the engine even though the engine is tilted in any direction.

The blowby gases are mixed in air flowed into the oil chamber (inside of an oil tank). Thus, the air flowed into the oil chamber means a mixture of the air and the blowby gases in the specification and claims without explanation.

DETAILED DESCRIPTION OF THE PREFERRED EMBODIMENTS

Figure 1:
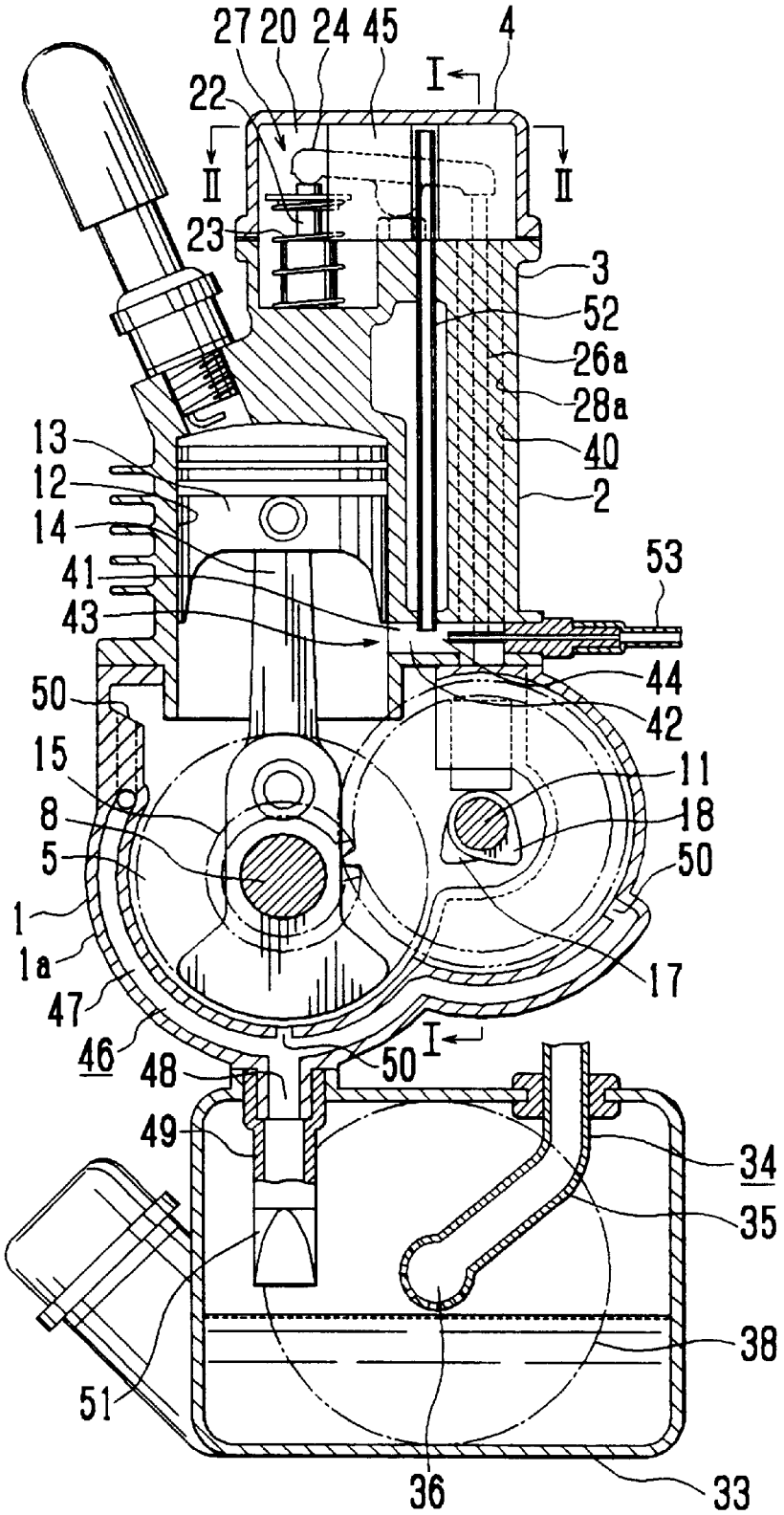
FIG. 1 is a longitudinal sectional front view of a four-stroke-cycle engine in the first embodiment according to the present invention.
Figure 2:
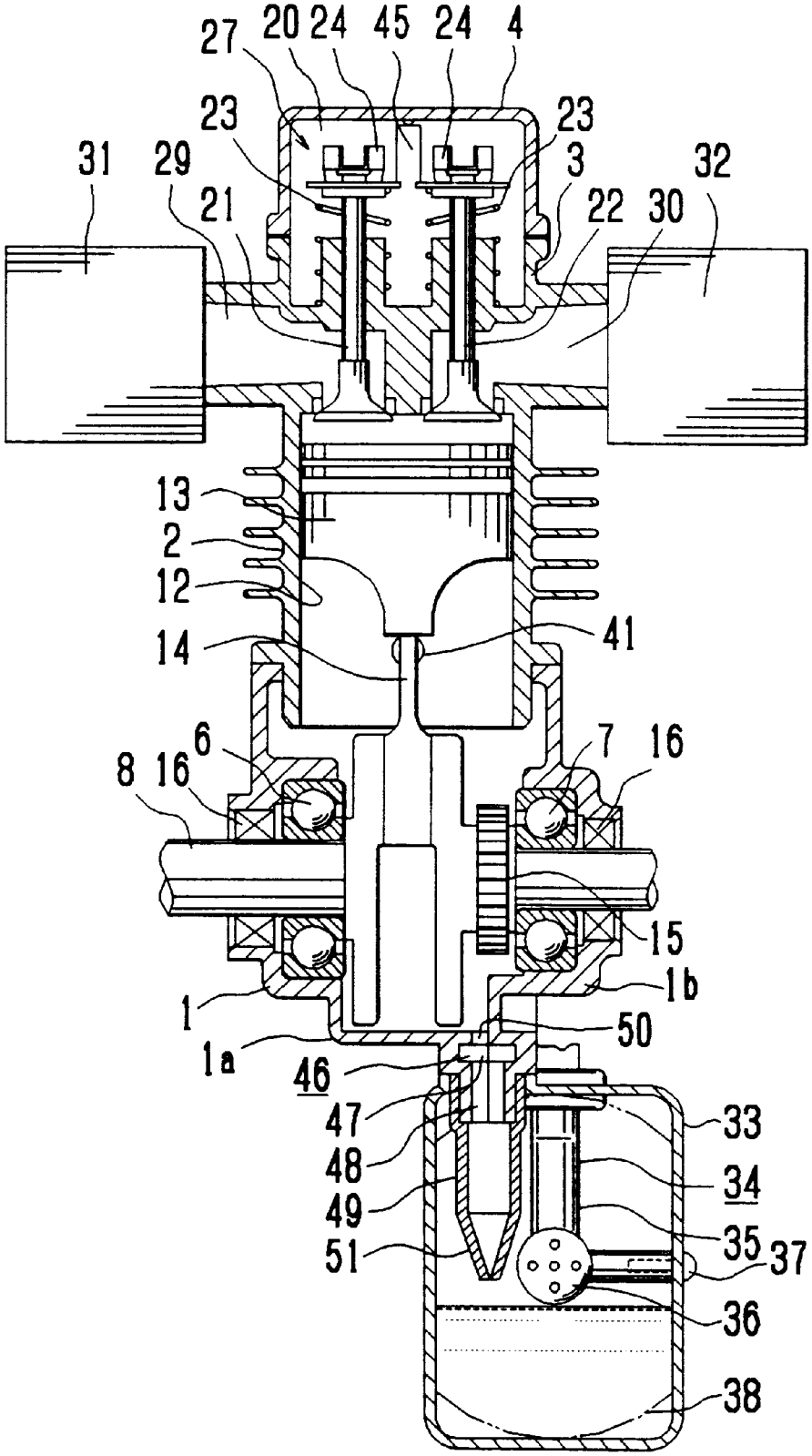
FIG. 2 is a longitudinal sectional side view which shows the four-stroke-cycle engine.
Figure 3:
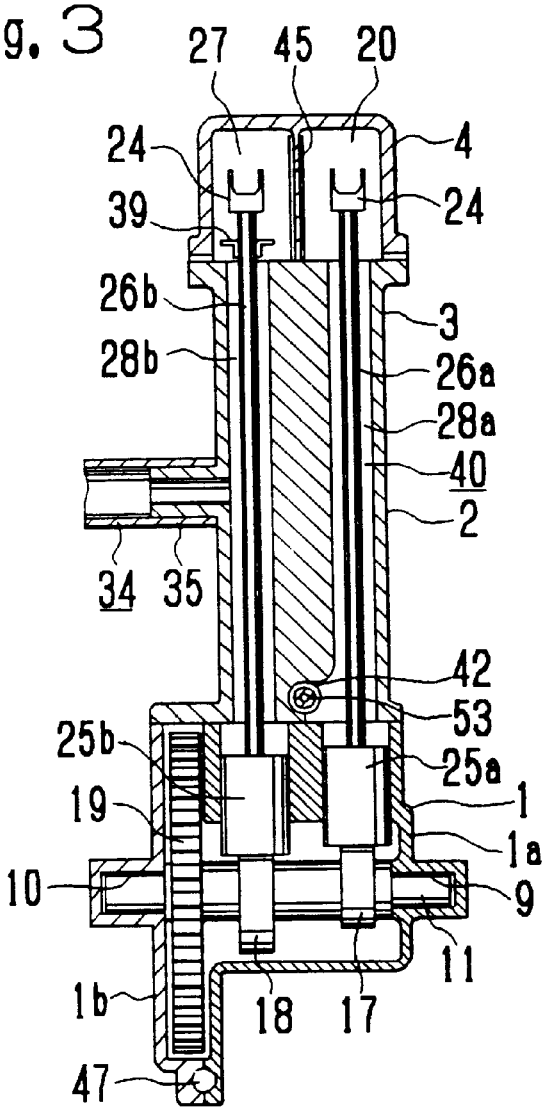
FIG. 3 is a sectional view taken along the line I—I in FIG. 1.
Figure 4:
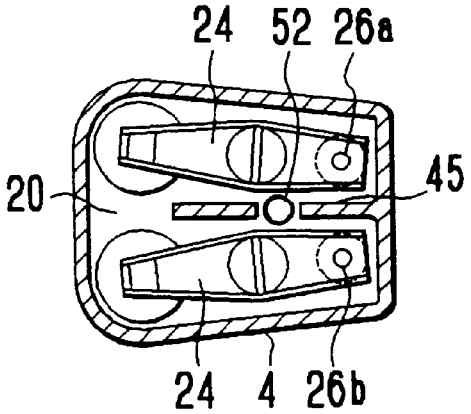
FIG. 4 is a sectional view taken along the line II—II in FIG. 1.
Figure 5:
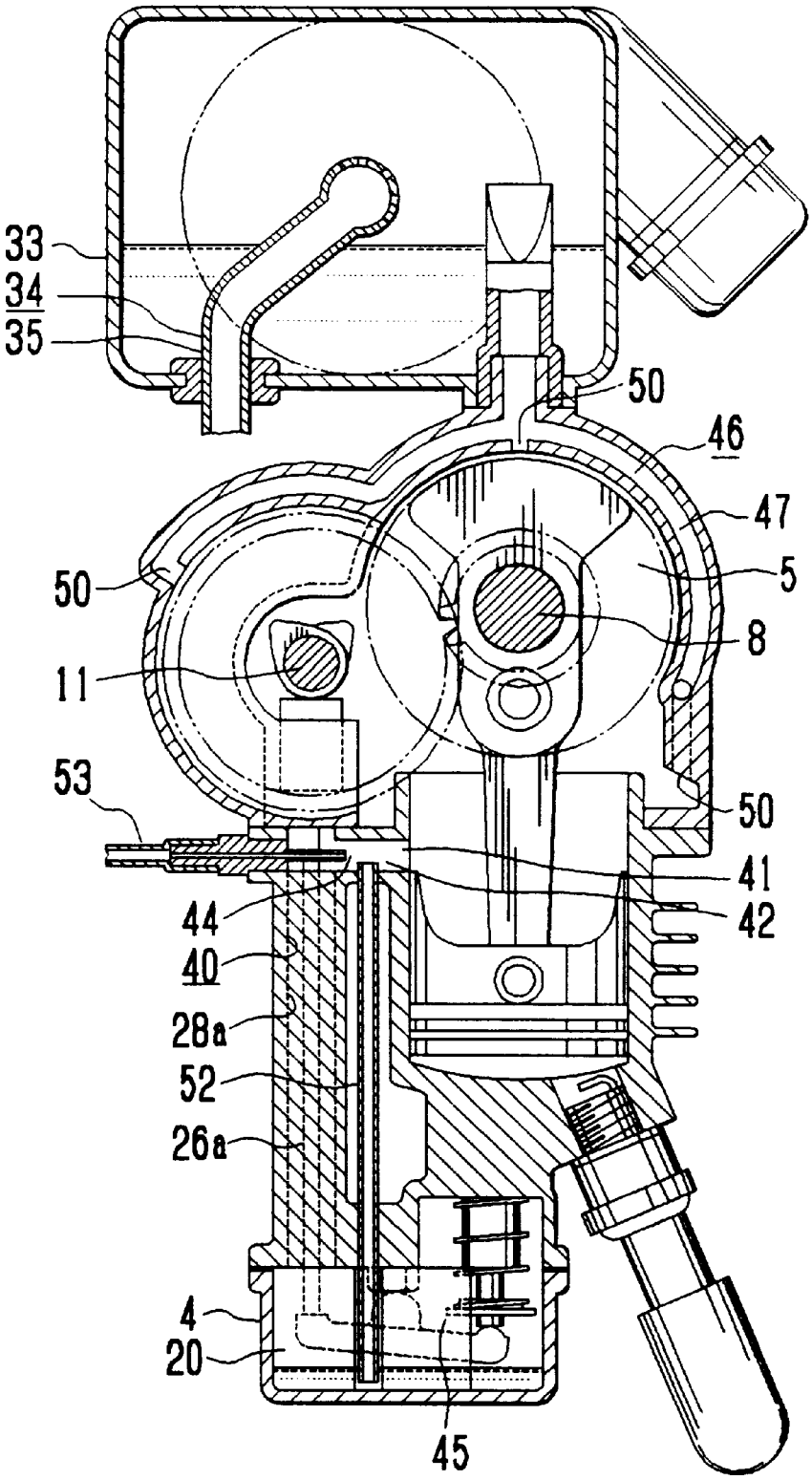
FIG. 5 is a longitudinal sectional front view of the four-stroke-cycle engine positioned upside down.

A first embodiment according to the present invention will be explained with reference to FIG. 1 to FIG. 5. FIG. 1 is a longitudinal sectional front view of a four-stroke-cycle engine for use on a portable work machine. FIG. 2 is a longitudinal sectional side view which shows the four-stroke-cycle engine. FIG. 3 is a sectional view taken along the line I—I in FIG. 1. FIG. 4 is a sectional view taken along the line II—II in FIG. 1. FIG. 5 is a longitudinal sectional front view of the four-stroke-cycle engine positioned upside down.

A cylinder block 2 is attached on the upper part of a crank case 1. A cylinder head 3 is mounted on the cylinder block 2. A rocker cover 4 is mounted on the upper part of the cylinder head 3. The crank case 1 is formed by a casing 1*a* and a crank case cover 1*b* attached to a side face of the casing 1*a* as shown in FIGS. 2 and 3. A crank chamber 5 is formed by the surrounding structure of the casing 1*a* and the crank case cover 1*b*.

In the crank chamber 5 the crank shaft 8 is supported at both ends on bearings 6 and 7 and cam shaft 11 is supported at one end on bearing 9 formed with the casing 1*a* and at another end on bearing 10 formed with the crank case cover 1*b* are rotatably provided. On the crank shaft 8 is connected a piston 13 which is reciprocated in a cylinder 12 formed in the cylinder block 2. The piston 13 is connected to the crank shaft 8 via a connecting rod 14. A crank gear 15 is also installed on the crank shaft 8. Both ends of the crank shaft 8 are penetrated through the casing 1*a* and the crank case cover 1*b* and stick out of them. At the portions where the crank shaft 8 penetrates through the casing 1*a* and the crank case cover 1*b* there are provided oil seals 16. The oil seals 16 are arranged adjacent to the bearings 6 and 7. On the cam shaft 11 are fixedly mounted an inlet cam 17 and an outlet cam 18 and also fixedly mounted is an cam gear 19 meshed with the crank gear 15.

The space covered with the rocker cover 4 above the cylinder head 3 servers as a valve chamber 20, within which a valve mechanism 27 is housed. The valve mechanism 27 comprising: an inlet valve 21 and an outlet valve 22 attached to the cylinder head 3, springs 23 for pressing the inlet valve 21 and the outlet valve 22 toward closing, rocker arms 24 for pressing the inlet valve 21 and the outlet valve 22 toward opening, and push rods 26*a* and 26*b* with one end to be contacted with the rocker arms 24 and another end to be contacted with the inlet cam 17 and the outlet cam 18 via tappets 25*a* and 25*b*. In the cylinder block 2 and the cylinder head 3 are formed push rod passages 28*a* and 28*b* in which the push rods 26*a* and 26*b* are housed. One end of each of the push rod passages 28*a* and 28*b* are connected to the valve chamber 20. The push rod passages 28*a* and 28*b* are separated from each other.

In the cylinder head 3 an inlet port 29 for supplying a mixture to a combustion chamber provided in the cylinder 12 and an outlet port 30 for exhausting exhaust gases from the combustion chamber are formed. A carburetor 31 and an air cleaner (not shown) are connected with the end of the inlet port 29. A muffler 32 is connected with the end of the outlet port 30.

On the lower part of the crank case 1 is attached an oil tank 33 for reserving the lubricating oil. There is provided an oil supply passage 34 between the oil tank 33 and the valve chamber 20 for supplying the oil in the oil tank 33 to the valve chamber 20. The oil supply passage 34 is composed of an oil supply pipe 35 inserted at one end into the oil tank 33 and connected at another end to the push rod passage 28*b*. An oil inlet 36 of the oil supply pipe 35 inserted in the oil tank 33 is fixed by a screw 37 so as to be located at the center of the oil tank 33. Around the oil inlet 36 is attached an absorber 36 having permeability, e.g. a felt, an urethane foam, etc. On the push rod 26*b* positioned in the valve chamber 20 is fixed an oil splashier 39 for making the oil in the form of fine particles.

Between the valve chamber 20 and the crank chamber 5 there is provided an oil feed passage 40 for feeding the oil supplied to the valve chamber 20 to the crank chamber 5. The oil feed passage 40 is composed of the push rod passage 28*a*, and a passage 42 formed in the cylinder block 2 and connected at one end with the push rod passage 28*a* and connected at another end with the crank chamber 5 via a vent 41. The vent 41 is opened and shut according to the reciprocation of the piston 13 and opened when the piston 13 goes upward to top dead point or center. The vent 41 and the piston 13 form a first check valve 43 which allows the oil to merely feed from the valve chamber 20 into the crank chamber 5. Adjacent to the vent 41 of the passage 42 there is provided a restrictor 44 for restricting the air flow in the passage 42.

Between the crank chamber 5 and the oil tank 33 there is provided a return passage 46 for returning the oil from the crank chamber 5 into the oil tank 33. The return passage 46 is composed of a ditch-like passage 47 formed in the crank case 1 along the rotating direction of the crank shaft 8, a fork passage 48 forked from the ditch-like passage 47, and a connecting pipe 49 connected with the fork passage 48 and inserted into the oil tank 33. The ditch-like passage 47 is connected with the crank chamber 5 by three return vents 50 formed in the inner surface of the crank chamber 5 along the rotating direction of the crank shaft 8 at constant intervals. At an end of the connecting pipe 49 a second check valve 51 is formed so as to allow the oil flowed in the return passage 46 to only return from the crank chamber 5 into the oil tank 33.

A bypass pipe 52 which is a bypass passage is inserted into the cylinder block 2 and cylinder head 3. The bypass pipe 52 is connected at one end to the ceiling of the valve chamber 20 and is faced at another end to the restrictor 44.

There is provided a blowby gas exhaust pipe 53 which is a blowby gas exhaust passage for exhausting blowby gases. The blowby gas exhaust pipe 53 is faced at one end to the restrictor 44 and is connected at another end to the air cleaner which is not shown.

During operation of the four-stroke cycle engine, on the upward stroke of the piston 13, the negative pressure is built up in the crank chamber 5. When the piston 13 reaches the top dead point and the negative pressure in the crank chamber 5 becomes highest, the first check valve 43 is opened and the vent 41 is also opened. Then, the oil from the valve chamber 20 is fed into the crank chamber 5 through the oil feed passage 40 with gases from the valve chamber 20 including blowby gases.

When the positive pressure is built up in the crank chamber 5 in accordance with the downward stroke of the piston 13, second check valve 51 is opened, then the oil from the crank chamber 5 is returned into the oil tank 33 through the return passage 46. At the same time, the oil from the oil tank 33 is fed into the valve chamber 20 through the oil supply passage with gases from the oil tank 33 including blowby gases. The oil, therefore, circulates to the oil tank 33, the valve chamber 20, the crank chamber 5 and the oil tank 33 using pressure fluctuation according to reciprocation of the piston, then, the valve mechanism 27 in the valve chamber 20, the crank shaft 8, the cam shaft 11 and the gears 15 and 19 in the crank chamber 5, and etc. are lubricated.

The oil supplying operation from the oil tank 33 into the valve chamber 20 will be explained in detail. In the oil tank 33 the oil is reserved in a quantity less than a certain quantity. Thus, the oil inlet 36 positioned at the center of the oil tank 33 is not soaked in the oil held in the oil tank 33, it can be prevented that the large amount of the oil flows into the valve chamber 20 from the oil tank 33, even when the engine is tilted in any direction. When the oil is supplied from the oil tank 33 into the valve chamber 20, the oil absorbed in the absorber 38 is supplied so as to be blown up by the gases including blowby gases in the oil tank 33. Thus, the oil supplied into the valve chamber 20 becomes mist in condition. Further, the oil in the mist condition is scattered in a form of fine particles by the oil splashier 39 fixed on the push rod 26*b*. Accordingly, the oil in a form of fine particles is supplied into the valve chamber 20, the valve chamber 20 can be well lubricated. The oil can be supplied into the valve chamber 20 even when the engine is tilted in any direction.

The oil supplied into the valve chamber 20 is guided by the guide wall 45 and is fed into the push rod passage 28*a* which is a part of the oil feed passage 40 after flowing within the whole area of the valve chamber 20. Thus, the oil supplied into the valve chamber 20 can lubricate the valve mechanism 27 efficiently.

The oil feeding operation from the valve chamber 20 into the crank chamber 5 will be explained in detail. On the upward stroke of the piston 13, the negative pressure is built up in the crank chamber 5, when the piston 13 reaches the top dead point, the vent 41 is opened and the oil from the valve chamber 20 is inhaled into the crank chamber 5 according to the negative pressure in the crank chamber 5. Then, the oil from the valve chamber 20 is fed into the crank chamber 5. When the piston 13 reaches the top dead point, the negative pressure in the crank chamber 5 becomes highest, then, the oil is well fed from the valve chamber 20 into the crank chamber 5.

In this case, it is not necessary to provide a special valve as the first check valve 43, thus, the reduction of the number of the parts and the reduction of cost can be done. This is because the vent 41 is opened and shut by the reciprocation of the piston 13 and is opened on the top dead point of the piston 13, then, the first check valve 43 is formed by the vent 41 and the piston 13. Also, the oil from the valve chamber 20 can be well fed into the crank chamber 5 since the negative pressure in the crank chamber 5 becomes highest when the first check valve 43 is opened.

When the engine is inverted, the oil remains in the ceiling of the valve chamber 20. There is, however, provided the bypass pipe 52 which is opened at one end to the ceiling of the valve chamber 20 and facing at another end the restrictor 44 adjacent to the vent 41. The velocity of the gases flowed in the passage 42 which is part of the oil feed passage 40 becomes high at the restrictor 44. Thus, a large negative pressure is generated at the restrictor 44. The oil remaining in the ceiling of the valve chamber 20, therefore, is blown up by the negative pressure generated in the restrictor 44 through the bypass pipe 52 and is supplied into the crank chamber 5. Consequently, it can be prevented that excessive oil remains in the valve chamber 20 even when the engine is use upside down. Thus, the oil from the valve chamber 20 can be supplied into the crank chamber 5 even when the engine is tilted in any direction.

The oil returning operation from the crank chamber 5 into the oil tank 33 will be explained in detail. On the downward stroke of the piston 13, the positive pressure is built up in the crank chamber 5, then, the second check valve 51 is opened. When the second check valve 51 is opened, the oil from the crank chamber 5 is returned into the oil tank 33 through the return passage 46. The oil from the crank chamber 5 goes into the return passage 46 through the return vents 50 formed at the inner surface of the crank chamber 5. Three return vents 50 are provided and are formed at constant intervals respectively, in the whole inner surface of the crank chamber 5 along the rotating direction of the crank shaft 8. Thus, the oil goes into the return passage 46 through the return vent 50 positioned lowest to the direction of gravity and the oil in the mist condition goes into the return passage 46 through the other return vents 50 even when the engine is tilted in any direction. Accordingly, the oil can be returned smoothly from the crank chamber 5 into the oil tank 33, excessive oil never remaining in the crank chamber 5 even when the engine is tilted in any direction.

In the present embodiment, since the return passage 46 is formed within the wall of the crank case 1, the return passage 46 is not exposed to the outer surface of the crank case 1. Thus, the four-stroke-cycle engine can be compactly formed.

The blowby gases exhausting operation will be explained. On the downward stroke of the piston 13, the positive pressure is built up in the crank chamber 5, the oil tank 33 and the valve chamber 20, the blowby gases from the oil feed passage 40 and the valve chamber 20 flow into the blowby gas exhaust pipe 53 in accordance with the positive pressure, then, the blowby gases are exhausted to the air cleaner. Here, at the position facing to the restrictor 44 connected to the one end of the blowby gas exhaust pipe 53, when the piston 13 stroked upward in the previous process, great negative pressure was generated around the restrictor 44, then, most of the oil was inhaled into the crank chamber 5. Thus, only a small amount of the oil exists in the blowby gases, and as such, the oil is not wasted when the blowby gases are exhausted from blowby gas exhaust pipe 53 facing at one end to the restrictor 44.

In the present embodiment, three return vents 50 are provided and are formed at constant intervals respectively in the whole inner surface of the crank chamber 5 along the rotating direction of the crank shaft 8, as one embodiment. It is, however, possible that more than four return vents 50 are provided. Also, it is not limited to the embodiment where the return vents 50 are formed in the inner surface of the crank chamber 5 along the rotating direction of the crank shaft 8.

In the present embodiment, the push rod passage 28*a* houses the push rod 26*a* for driving the inlet valve 21 and the push rod passage 28*b* houses the push rod 26*b* for driving the outlet valve 22 are separated, the push rod passage 28*b* is used as the part of the oil supply passage 34, and the push rod passage 28*a* is used as the oil feed passage 40. It is, therefore, not necessary to separately form the part of the oil supply passage 34 and the oil feed passage 40. Thus, the parts, product processes and product costs can be reduced.

Figure 6:
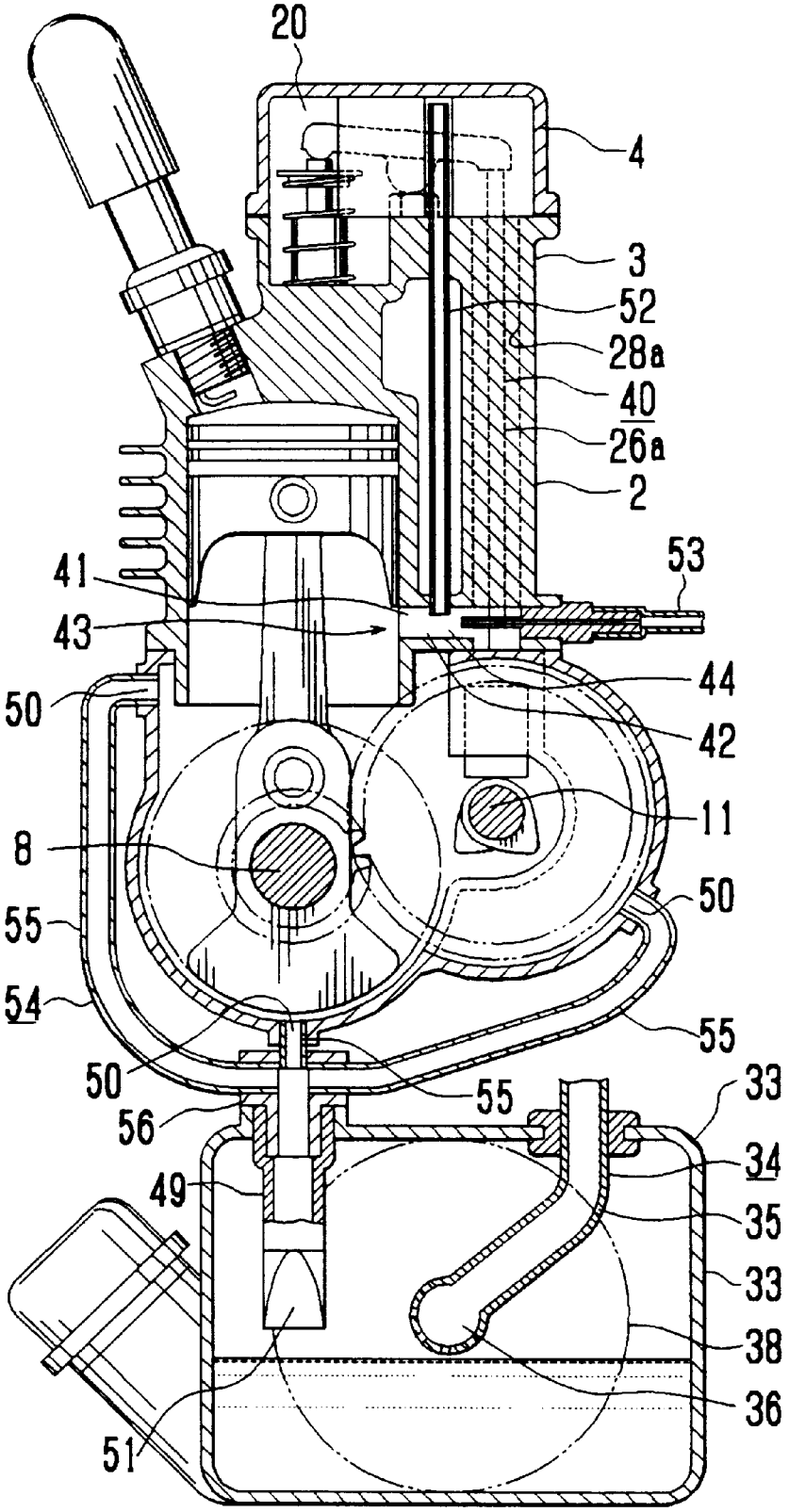
FIG. 6 is a longitudinal sectional front view of the four-stroke-cycle engine in the second embodiment according to the present invention.

A second embodiment according to the present invention will be explained with reference to FIG. 6. Parts the same as those in the first embodiment are designated by the same reference numerals and therefore are not explained herein.

A return passage 54 for returning the oil from the crank chamber 5 into the oil tank 33 is composed of three return pipes 55 arranged on the outer surface of the crank case 1, a fork pipe 56 connected with the return pipes 55, and the connecting pipe 49 connected at one end to the fork pipe 56 and inserted at another end in the oil tank 33. The ends of each return pipe 55 are connected with the return vents 50 formed on the crank case 1.

In operation, when the positive pressure is built up in the crank chamber 5 in accordance with the downward stroke of the piston 13, second check valve 51 is opened, then the oil from the crank chamber 5 is returned into the oil tank 33 through the return passage 54. Here, since the return passage 54 is formed by the return pipe 55 arranged on the outer surface of the crank case 1, it is easy to form the return passage 54.

Figure 7:
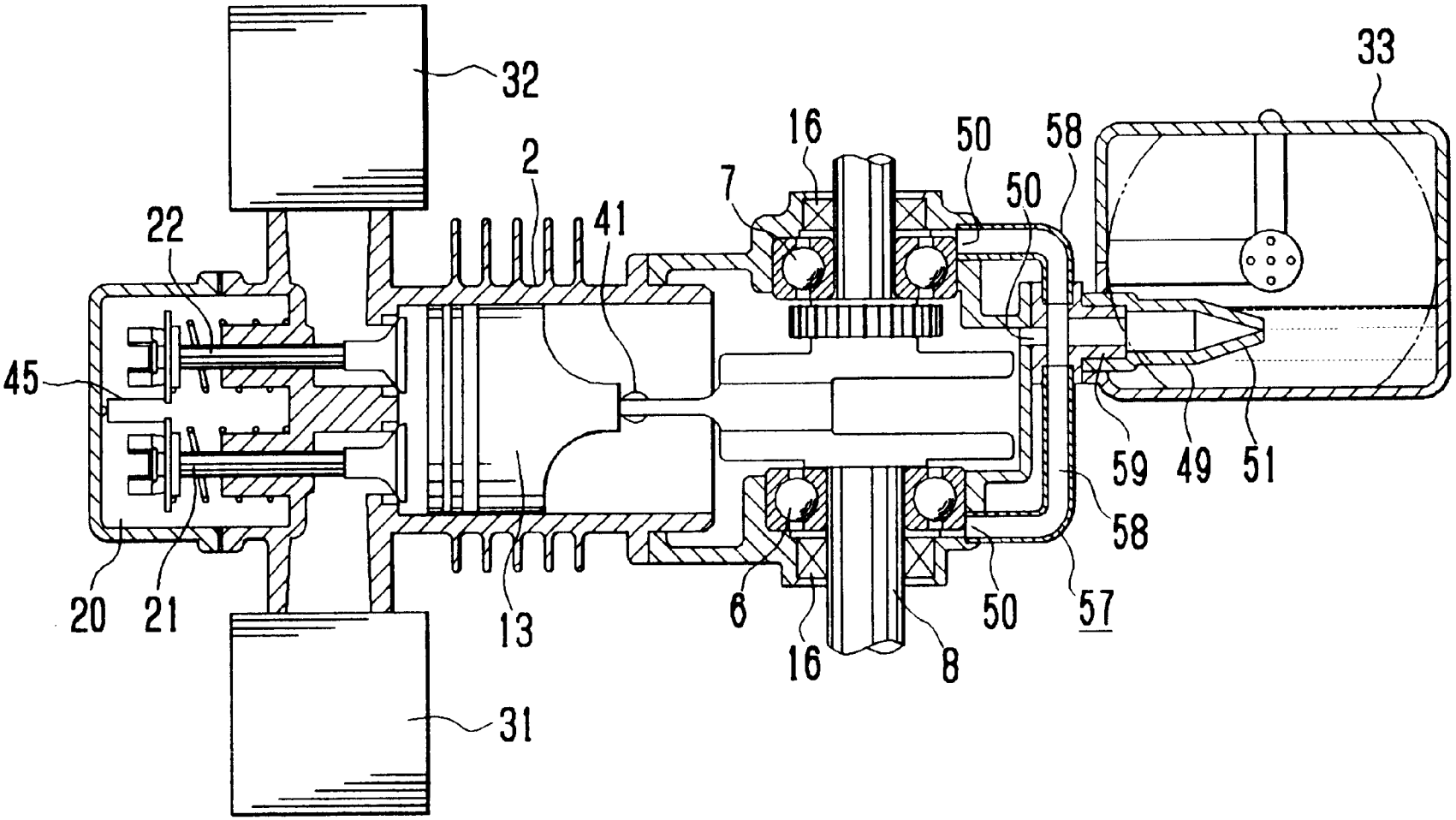
FIG. 7 is a longitudinal sectional front view of the four-stroke-cycle engine in the third embodiment according to the present invention.

A third embodiment according to the present invention will be explained with reference to FIG. 7. Parts the same as those in the first embodiment are designated by the same reference numerals and therefore are not explained herein.

A return passage 57 for returning the oil from the crank chamber 5 into the oil tank 33 is composed of two return pipes 58 arranged on the outer surface of the crank case 1, a fork pipe 59 connected with the return pipes 58, and the connecting pipe 49 connected at one end to the fork pipe 59 and inserted at another end in the oil tank 33. Each end of the return pipes 58 are respectively connected with each of the return vents 50 formed on the crank chamber 5 so as to face to a space between the pair of bearings 6 and 7 for supporting the crank shaft 8 and the pair of oil seals 16 for sealing the portions that the crank shaft 8 penetrates into the crank case 1. Further, the return vents 50 formed on the bottom of the crank chamber 5 are connected with the fork pipe 59.

In operation, when the engine is used in position that the crank shaft 8 is positioned perpendicular from a normal position, the oil in the crank chamber 5 flows around the lower bearing 6 and oil seal 16. Then, the oil flows from there into the lower return pipe 58 through the lower return vent 50 facing the space between the bearing 6 and the oil seal 16, the oil flowing into the return pipe 58 is blown up by the gases flowing in the return pipe 58 and is returned into the oil tank 33. Therefore, it can be prevented that the oil remains around the lower bearing 6, this is an advantage since the remaining oil provides resistance against the rotation of the crank shaft 8. Further, since the oil in the mist condition from the upper return vent 50 flows into the return passage 57, the upper bearing 7 is lubricated by the oil in the mist condition.

Figure 8:
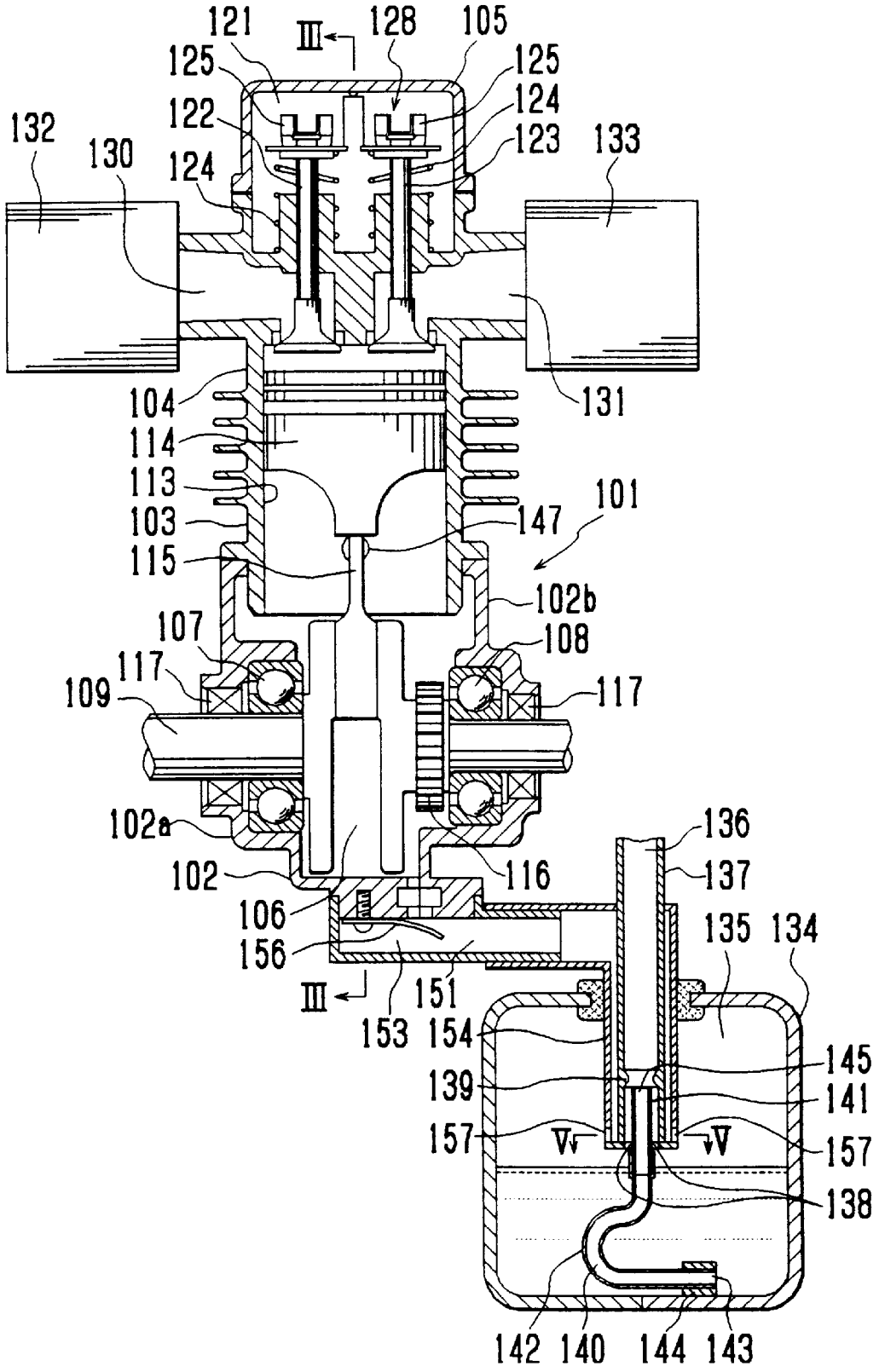
FIG. 8 is a longitudinal sectional front view of the four-stroke-cycle engine in the fourth embodiment according to the present invention.
Figure 9:
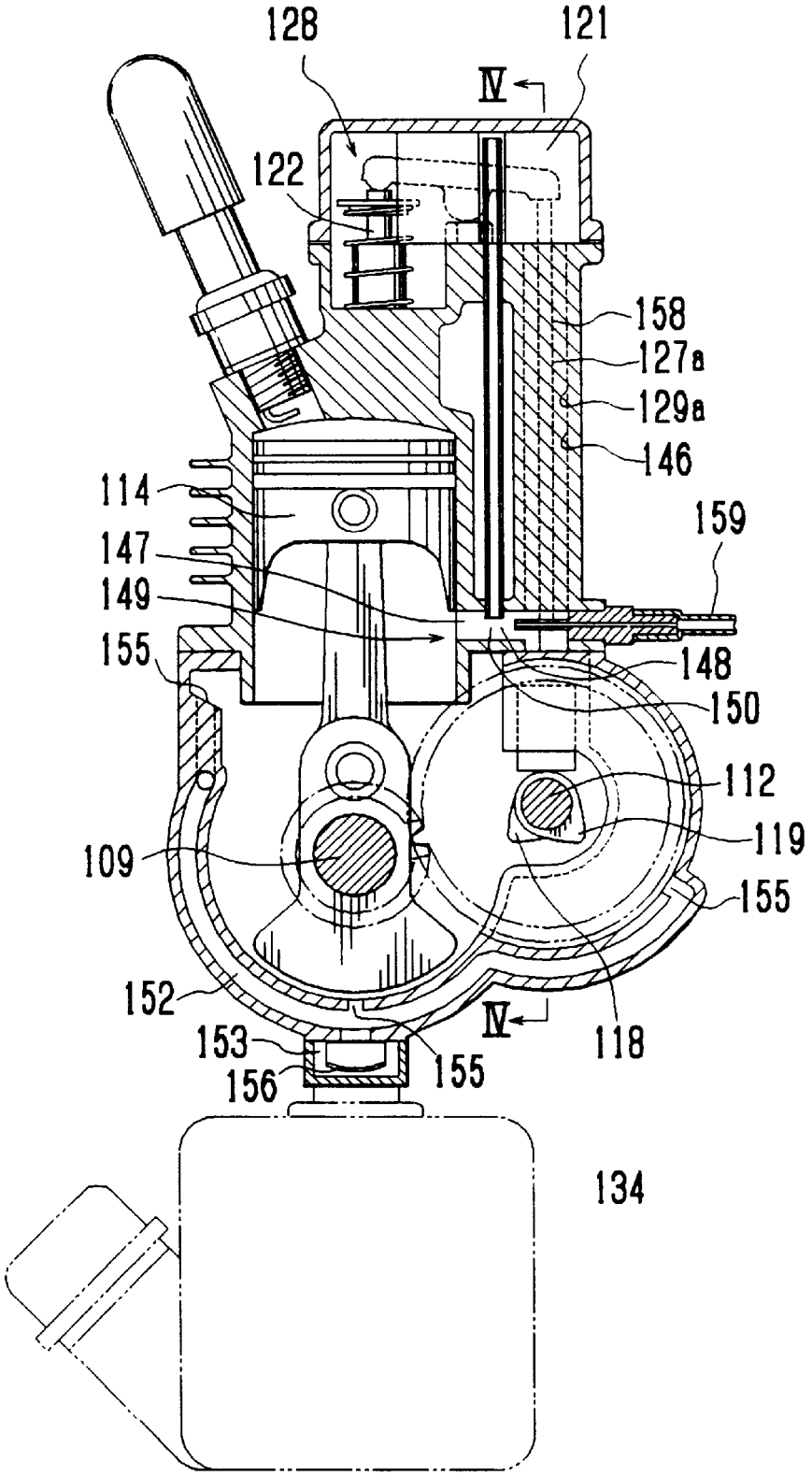
FIG. 9 is a sectional view taken along the line III—III in FIG. 8.
Figure 10:
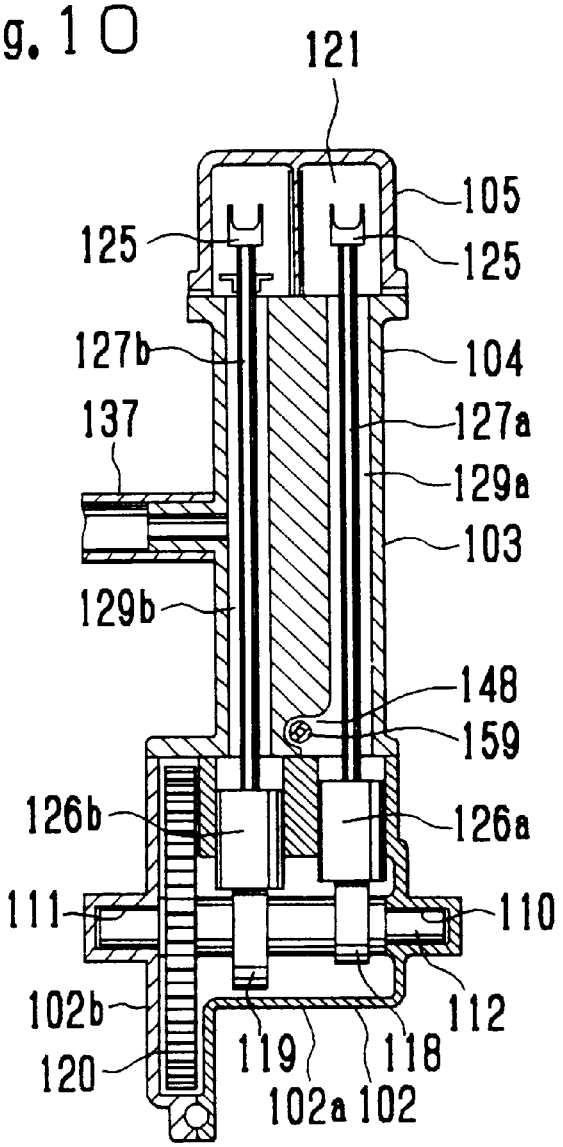
FIG. 10 is a sectional view taken along the line IV—IV in FIG. 9.
Figure 11:
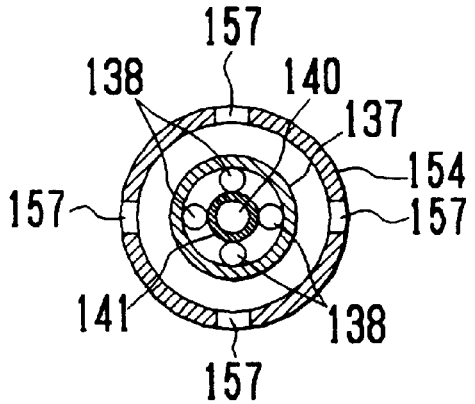
FIG. 11 is a sectional view taken along the line V—V in FIG. 8.
Figure 12:
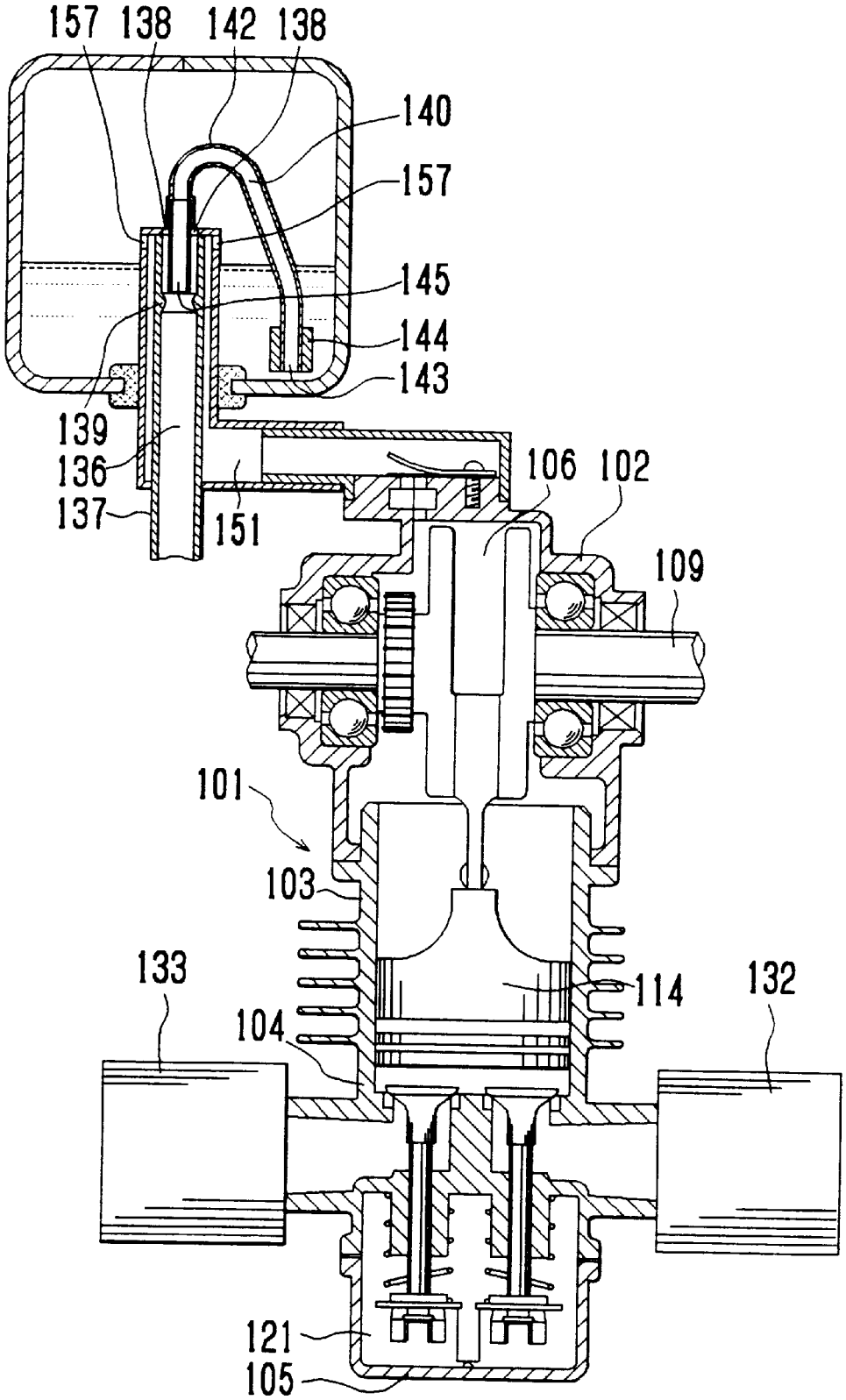
FIG. 12 is a longitudinal sectional front view of the four-stroke-cycle engine positioned upside down.

A fourth embodiment according to the present invention will be explained with reference to FIG. 8 to FIG. 12. FIG. 8 is a longitudinal sectional front view of the four-stroke-cycle engine for use on a portable work machine. FIG. 9 is a sectional view taken along the line III—III in FIG. 8. FIG. 10 is a sectional view taken along the line IV—IV in FIG. 9.

A cylinder block 103 is attached on the upper part of a crank case 102. A cylinder head 104 is mounted on the cylinder block 103. A rocker cover 105 is mounted on the upper part of the cylinder head 104. The crank case 102 is formed by a casing 102*a* and a crank case cover 102*b* attached to a side face of the casing 102*a*. A crank chamber 106 is formed by the surrounding structure of the casing 102*a* and the crank case cover 102*b*.

In the crank chamber 106 the crank shaft 109 supported at both ends on bearings 107 and 108 and cam shaft 112 supported at one end on bearing 111 formed with the casing 102*a* and at another end on bearing 110 formed with the crank case cover 102*b* are rotatably provided. On the crank shaft 109 is connected a piston 114 reciprocated in a cylinder 113 formed in the cylinder block 103. The piston 114 is connected to the crank shaft 109 via a connecting rod 115. A crank gear 116 is also installed on the crank shaft 109. Both ends of the crank shaft 109 penetrate through the casing 102*a* and the crank case cover 102*b* and stick out of them. At the portions where the crank shaft 109 penetrates through the casing 102*a* and the crank case cover 102*b* there are provided oil seals 117. On the cam shaft 112 are fixedly mounted an inlet cam 118 and an outlet cam 119 and also fixedly mounted is a cam gear 120 meshed with the crank gear 116.

The space covered with the rocker cover 105 above the cylinder head 104 servers as a valve chamber 121, within which a valve mechanism 128 is housed. The valve mechanism 128 comprising: an inlet valve 122 and an outlet valve 123 attached to the cylinder head 104, springs 124 for pressing the inlet valve 122 and the outlet valve 123 toward closing, rocker arms 125 for pressing the inlet valve 122 and the outlet valve 123 toward opening, and push rods 127*a* and 127*b* with one end to be contacted with the rocker arms 125 and another end to be contacted with the inlet cam 118 and the outlet cam 119 via tappets 126*a* and 126*b*. In the cylinder block 103 and the cylinder head 104 are formed push rod passages 129*a* and 129*b* in which the push rods 127*a* and 127*b* are housed. One end of the push rod passages 129*a* and 129*b* are connected to the valve chamber 121. The push rod passages 129*a* and 129*b* are separated from each other.

In the cylinder head 104 an inlet port 130 for supplying a mixture to a combustion chamber provided in the cylinder 113 and an outlet port 131 for exhausting exhaust gases from the combustion chamber are formed. A carburetor 132 and an air cleaner (not shown) are connected with the end of the inlet port 130. A muffler 133 is connected with the end of the outlet port 131.

On the lower part of the crank case 102 an oil tank 134 is attached, the oil tank 134 contains an oil chamber 135 for reserving the lubricating oil. The oil chamber 135 and the valve chamber 121 are connected by an oil supply passage 136 for supplying the oil from the oil chamber 135 into the valve chamber 121. The oil supply passage 136 is composed of an oil supply pipe 137 inserted at one end into the oil chamber 135 and connected at another end to the push rod passage 129*b*. The end of the oil supply pipe 137 inserted in the oil chamber 135 is disposed at a center of the oil chamber 135. At the end of the oil supply pipe 137 an air inhalation vent 138 for inhaling the air existing in the oil chamber 135 is formed. In the oil supply pipe 137 adjacent to the air inhalation vent 138 there is provided a restrictor 139 having a small-sized diameter in the oil supply pipe 137.

In the oil chamber 135 there is provided an oil inhalation passage 140. The oil inhalation passage 140 is composed of an pipe 141 formed within the end of the oil supply pipe 137, having a small-sized diameter, and an elastic pipe 142 connected with the pipe 141, having elastic characteristics. In the end of the elastic pipe 142 is formed an oil inlet 143. Around the oil inlet 143 there is attached a weight 144 on the elastic pipe 142. The weight 144 contributes to ensure that the elastic pipe 142 is bent according to a tilt of the oil tank 134 so that the oil inlet 143 is always positioned at the lower part in the oil chamber 135. At another end of the elastic pipe 142 there is provided an oil outlet 145 facing the restrictor 139.

Between the valve chamber 121 and the crank chamber 106 there is provided an oil feed passage 146 for feeding the oil supplied to the valve chamber 121 to the crank chamber 106. The oil feed passage 146 is composed of the push rod passage 129*a*, and a passage 148 formed in the cylinder block 103 and connected at one end with the push rod passage 129*a* and connected at another end with the crank chamber 106 via a vent 147. The vent 147 is opened and shut according to the reciprocation of the piston 114 and opened when the piston 114 goes upward to a top dead point. The vent 147 and the piston 114 form a check valve 149 which allows the oil to feed from the valve chamber 121 into the crank chamber 106. Adjacent to the vent 147 of the passage 148 is provided a restrictor 150 for restricting the air flow in the passage 148.

Between the crank chamber 106 and the oil chamber 135 is provided a return passage 151 for returning the oil from the crank chamber 106 into the oil chamber 135. The return passage 151 is composed of a ditch-like passage 152 formed in the crank case 102 along the rotating direction of the crank shaft 109, a fork passage 153 forked from the ditch-like passage 152, and a return pipe 154 connected at one end with the fork passage 153 and inserted at another end into the oil chamber 135. The ditch-like passage 152 is connected with the crank chamber 106 by three return vents 155. Between the ditch-like passage 152 and the fork passage 153 is provided a lead valve 156, which is opened and shut according to the pressure fluctuation in the crank chamber 106, and for allowing the oil to feed from crank chamber 106 into the oil chamber 135.

In the oil chamber 135 from the outer surface of the oil tank 134 the return pipe 154 and the oil supply pipe 137 are overlapped. Thus, at the overlapped portion thermal conduction occurs easily. The end of the return pipe 154 inserted into the oil chamber 135 is disposed at a center of the oil chamber 135. At the end of the return pipe 154 is formed a return vent 157 for returning the oil into the oil chamber 135.

A bypass pipe 158 is inserted into the cylinder block 103 and the cylinder head 104. The bypass pipe 158 is connected at one end to the ceiling of the valve chamber 121 and faces at another end the restrictor 150.

There is provided a blowby gas exhaust pipe 159 for exhausting blowby gases. The blowby gas exhaust pipe 159 faces at one end the restrictor 150 and is connected at another end to the air cleaner which is not shown.

During operation of the four-stroke cycle engine, on the upward stroke of the piston 114, the negative pressure builds up in the crank chamber 106. When the piston 114 reaches the top dead point and the negative pressure in the crank chamber 106 becomes highest, then the check valve 149 is opened and the vent 147 is also opened. Then, the oil from the valve chamber 121 is fed into the crank chamber 106 through the oil feed passage 146 with gases from the valve chamber 121.

When the positive pressure is built up in the crank chamber 106 in accordance with the downward stroke of the piston 114, the gases with the oil from the return vent 157 of the return pipe 154 are fed into oil chamber 135. Then, since the pressure becomes high in the oil chamber 135, the gases from the oil chamber 135 are supplied into the oil supply passage 136 through the air inhalation vent 138 provided at the end of the oil supply pipe 137. Around the inlet of the oil supply passage 136 the restrictor having a small-sized diameter is formed. Thus, the velocity of the gases from the air inhalation vent 138 becomes high when the gases go through the restrictor 139. Then, the negative pressure is generated around the restrictor 139. Thus, the oil reserved in the oil chamber 135 is inhaled from the oil inlet 143 of the elastic pipe 142. Inhaled oil is fed into the oil supply passage 136 through the elastic pipe 142, the pipe 141 and the outlet 145. Then, the oil fed from the oil outlet 145 is mixed into the gases inhaled from the air inhalation vent 138, and oil in the mist condition is generated. The oil in the mist condition is supplied into the valve chamber 121 with the gases supplied into the oil supply passage 136 through the air inhalation vent 138 according to the ascent of the pressure in oil chamber 135. Consequently, it can be prevented that the oil in the liquid condition is directly supplied into the valve chamber 121 and that excessive oil is supplied into the valve chamber 121.

Little quantity of the oil in the mist condition supplied into the valve chamber 121 forms into the liquid condition. On the upward stroke of the piston 114, the negative pressure is built up in the crank chamber 106 and the vent 147 is opened, then, the oil in the mist condition and the liquid condition is supplied from the valve chamber 121 into the crank chamber 106.

The oil in the mist condition is generated by providing the air inhalation vent 138, the restrictor 139 and oil outlet 145 at the end of the oil supply pipe 137, feeding the oil from the oil outlet 145 and inhaling the gases from the air inhalation vent 138 using pressure fluctuation in the crank chamber 106, and mixing the oil within the gases speeded up at the restrictor 139. Accordingly, it is easy to generate the oil in the mist condition. In addition, the engine power does not decrease due to generating the oil in the mist condition.

The air inhalation vent 138 is disposed at the center of the oil chamber 135. Thus, in the oil chamber 135 the oil is reserved in a quantity less than certain quantity, so that the gases can be inhaled from the air inhalation vent 138 even when the four-stroke-cycle engine is tilted in any direction. Accordingly, the oil can be generated in the mist condition and the oil in the mist condition can be supplied into the valve chamber 121 and the crank chamber 106.

The elastic pipe 142 is used for inhaling the oil from the oil chamber 135. Thus, the oil inlet 143 can be moved to lower part of the oil chamber 135 even when the four-stroke-cycle engine is tilted in any direction. Accordingly, the oil can always be inhaled from the oil inlet 143 in case the amount of oil is decreased in the oil chamber 135.

On the downward stroke of the piston 114, the positive pressure is built up in the crank chamber 106, then, the lead valve 156 is opened. When the lead valve 156 is opened, the oil in the mist condition and in the liquid condition from the crank chamber 106 is returned into the oil chamber 135 through the return passage 151. The oil from the crank chamber 106 returns into the oil chamber 135 with the gases through the return vents 157. The return vents 157 are disposed at the center of the oil chamber 135, in the oil chamber 135 the oil is reserved in a quantity less than certain quantity, thus, it can be prevented that the gases from the return vent 157 mixes into the oil reserved in the oil chamber 135 and whips the oil surface, so that whipped oil can never be inhaled into the air inhalation vent 138. Consequently, the oil in the mist condition supplied into the valve chamber 121 through the oil supply passage 136 is kept at a constant mist density.

The oil and gases which flow into the oil chamber 135 through the return passage 151 have a high temperature since the oil and gases lubricate the rotating member and sliding member in the valve chamber 121 and the crank chamber 106. The oil and gases having a high temperature flow into the return pipe 154 overlapped with the oil supply pipe 137, so that the high temperature of the oil and the gases flowing into the return pipe 154 is transferred to the oil supply pipe 137. Thus, the oil in the mist condition supplied into the valve chamber 121 through the oil supply pipe 137 is warmed up, so that warming up of the engine can be shortened even at low temperatures.

When the engine is used upside down for many hours, generally, the oil in the liquid condition easily remains in the ceiling of the valve chamber 121. However, there is provided the bypass pipe 158 connected at one end to the ceiling of the valve chamber 121 and faced at another end to the restrictor 150 adjacent to the vent 147. So when a big negative pressure is generated around the restrictor 150, the oil remaining in the ceiling of the valve chamber 121 is blown up through the bypass pipe 158 by the negative pressure generated at the restrictor 150, then, the oil is fed into the crank chamber 106. It, therefore, can be prevented that excess oil remains in the valve chamber 121 even when the engine is driven upside down for many hours.

Further, the oil chamber 135 is formed in the oil tank 134 mounted on the engine body 101. Thus, the oil tank 134 can be mounted on the engine body 101 at any position. Also, as a result, compactness and lightness of the engine can be done easily.

Figure 13:
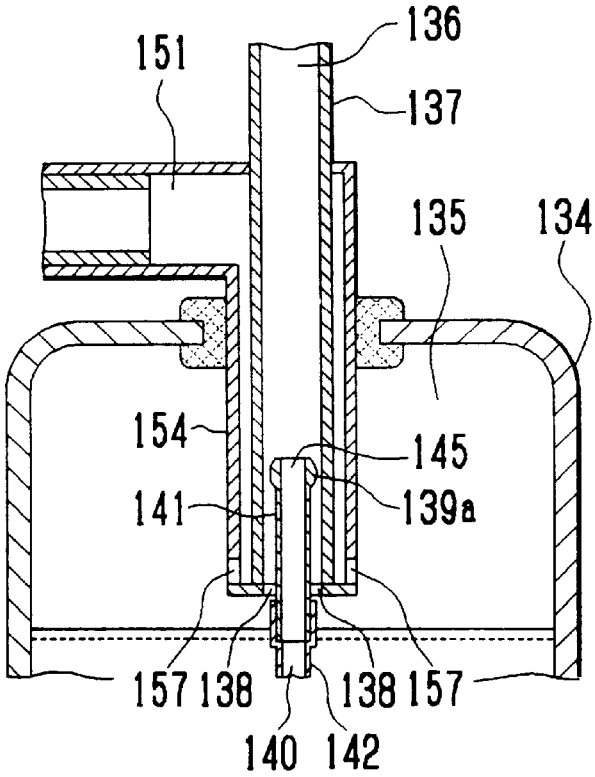
FIG. 13 is a longitudinal sectional front view of the four-stroke-cycle engine in the fifth embodiment according to the present invention.

A fifth embodiment according to the present invention will be explained with reference to FIG. 13. Parts the same as those in the fourth embodiment are designated by the same reference numerals and therefore are not explained herein.

The present embodiment relates to the structure for generating oil in the mist condition. There is provided the oil outlet 145 arranged in the oil supply pipe 137 at one end of the pipe 141. There is provided a restrictor 139*a* swelled out from the outer periphery of the pipe 141 at the oil outlet 145.

During operation of the four-stroke cycle engine, the oil reserved in the oil chamber 135 is inhaled into oil inlet 143 of the elastic pipe 142 and is fed into the oil supply pipe 137 from the oil outlet 145. The gases reserved in the oil chamber 135 are also inhaled into the air inhalation vent 138 and flow into the oil supply pipe 137. The gases inhaled from the air inhalation vent 138 into the oil supply pipe 137 speed up when the gases go by the restrictor 139*a*. Then, the sped up gases and the oil fed from the oil outlet 145 are mixed so that the oil in the mist condition is generated. Accordingly, the oil in the mist condition is generated well even though the restrictor 139*a* is formed at one end of the outer periphery of the pipe 141.

Figure 14:
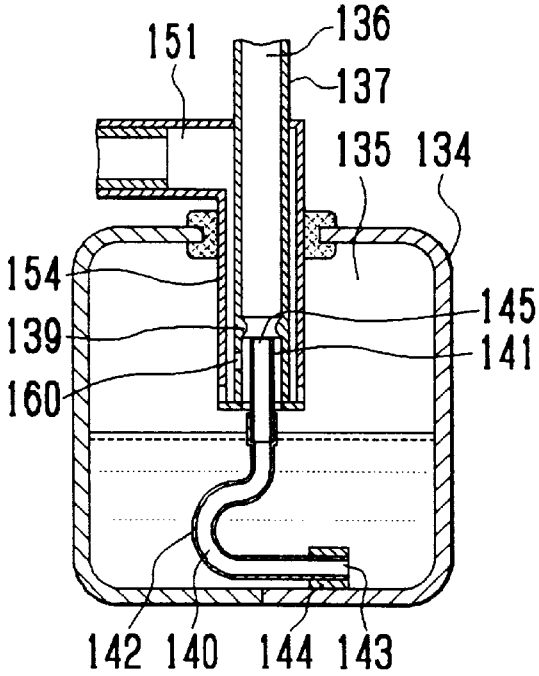
FIG. 14 is a longitudinal sectional front view of the four-stroke-cycle engine in the sixth embodiment according to the present invention.

A sixth embodiment according to the present invention will be explained with reference to FIG. 14. Parts the same as those in the fourth embodiment are designated by the same reference numerals and therefore are not explained herein.

In the present embodiment, there is provided a bypass passage 160 for connecting the oil supply passage 136 and the return passage 151 at one end of the oil supply pipe 137. The bypass passage 160 is connected with the oil supply passage 136 between the restrictor 139 and the air inhalation vent 138.

During the oil and gases, in which the temperature rises due to lubricating the rotating parts and sliding parts in the valve chamber 121 and crank chamber 106, returns into the oil chamber 135 through the return passage 151, the oil is partially fed into the valve chamber 121 through the bypass passage 160 and the oil supply passage 136. Thus, the oil in the mist condition flowing into the oil supply passage 136 is warmed up, so that the viscosity of the oil becomes low and warming up of the engine can be shortened even at low temperatures.

Figure 15:
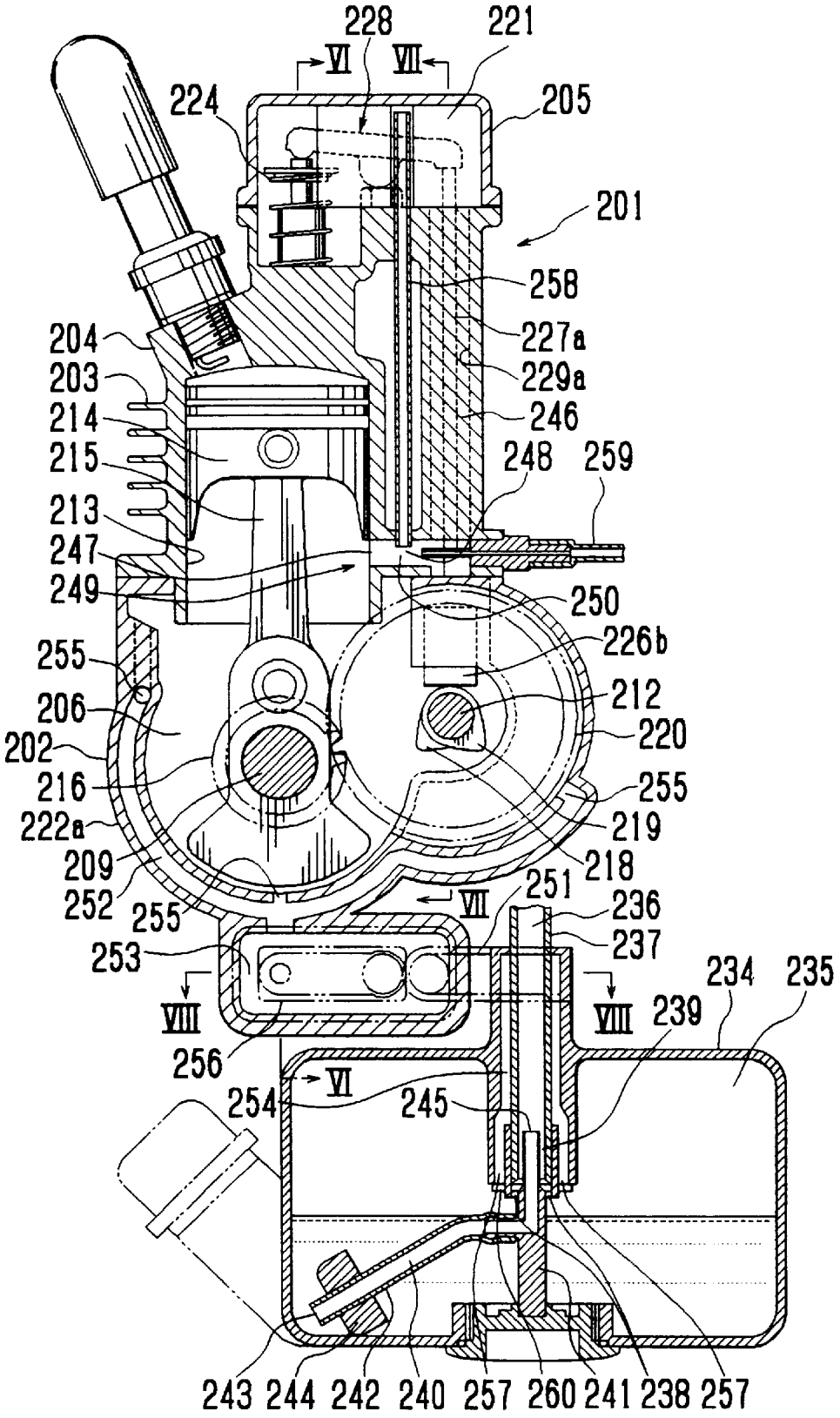
FIG. 15 is a longitudinal sectional front view of the four-stroke-cycle engine in the seventh embodiment according to the present invention.
Figure 16:
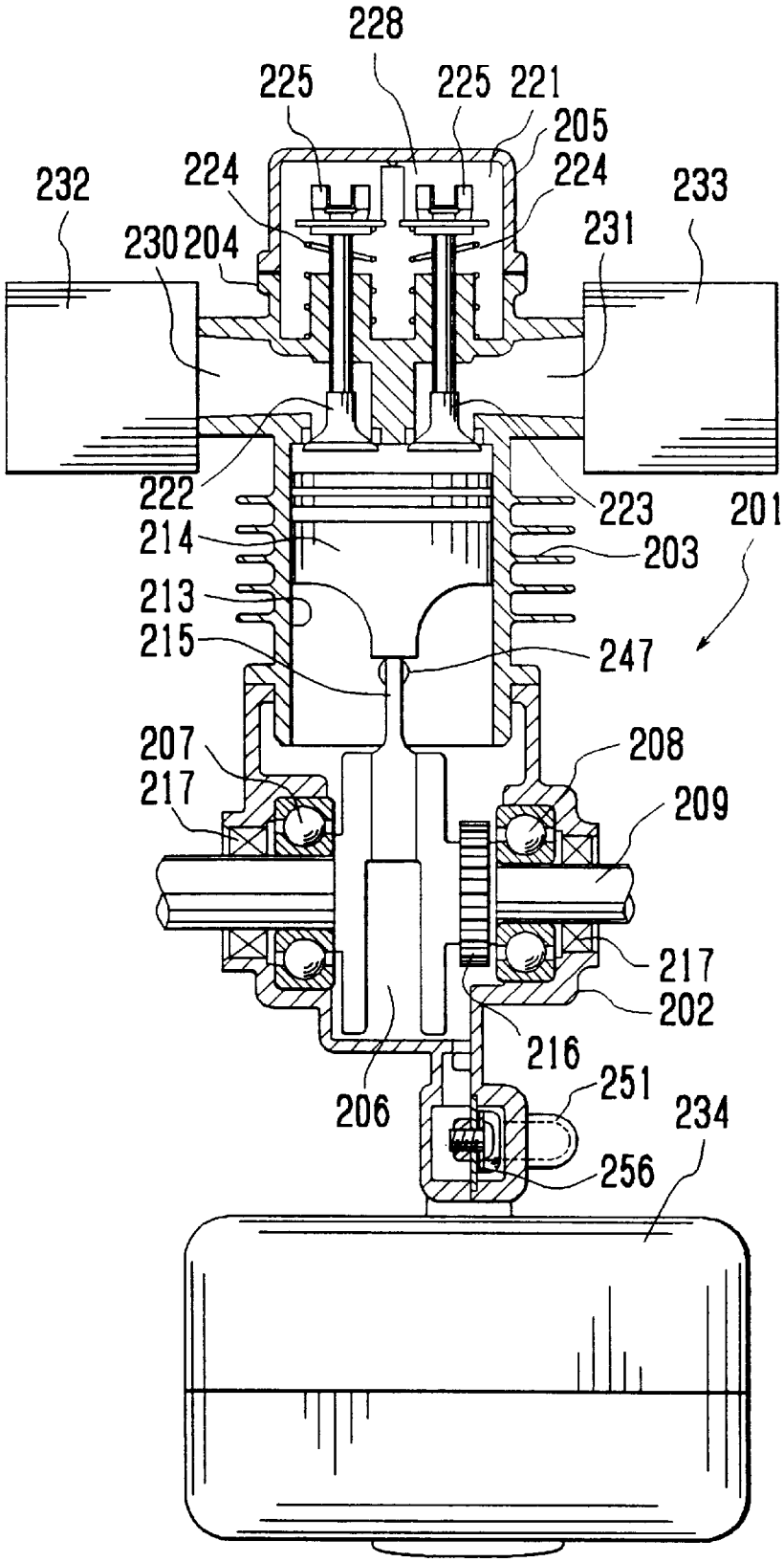
FIG. 16 is a sectional view taken along the line VI—VI in FIG. 15.
Figure 17:
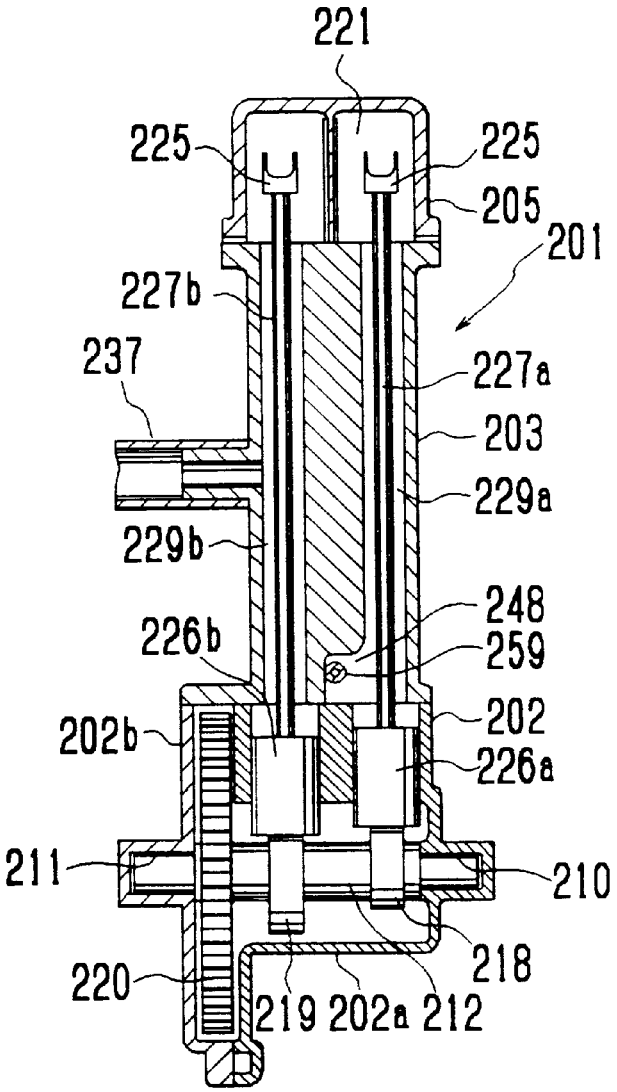
FIG. 17 is a sectional view taken along the line VII—VII in FIG. 15.
Figure 18:
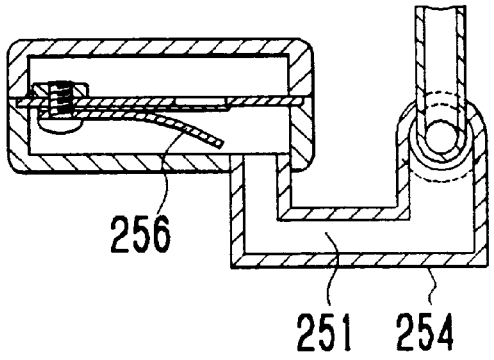
FIG. 18 is a sectional view taken along the line VIII—VIII in FIG. 15.
Figure 19:
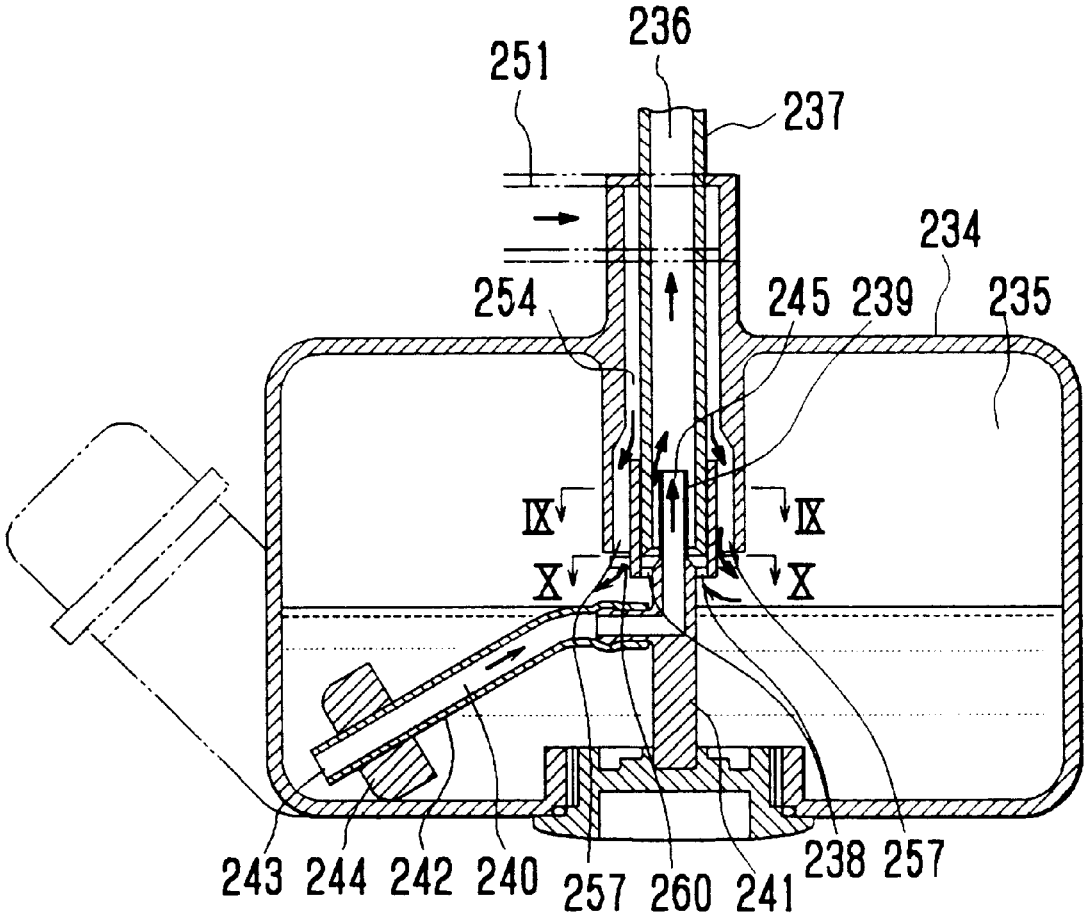
FIG. 19 is an enlarged longitudinal sectional front view around a oil tank.
Figure 20A:
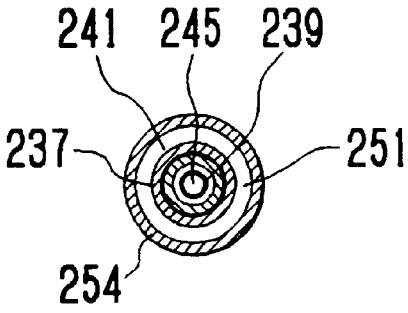
FIG. 20(A) is a sectional view taken along the line IX—IX in FIG. 19.
Figure 20B:
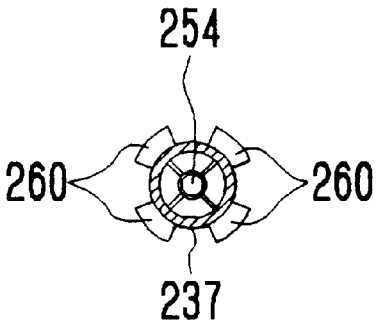
FIG. 20(B) is a sectional view taken along the line X—X in FIG. 19.
Figure 21:
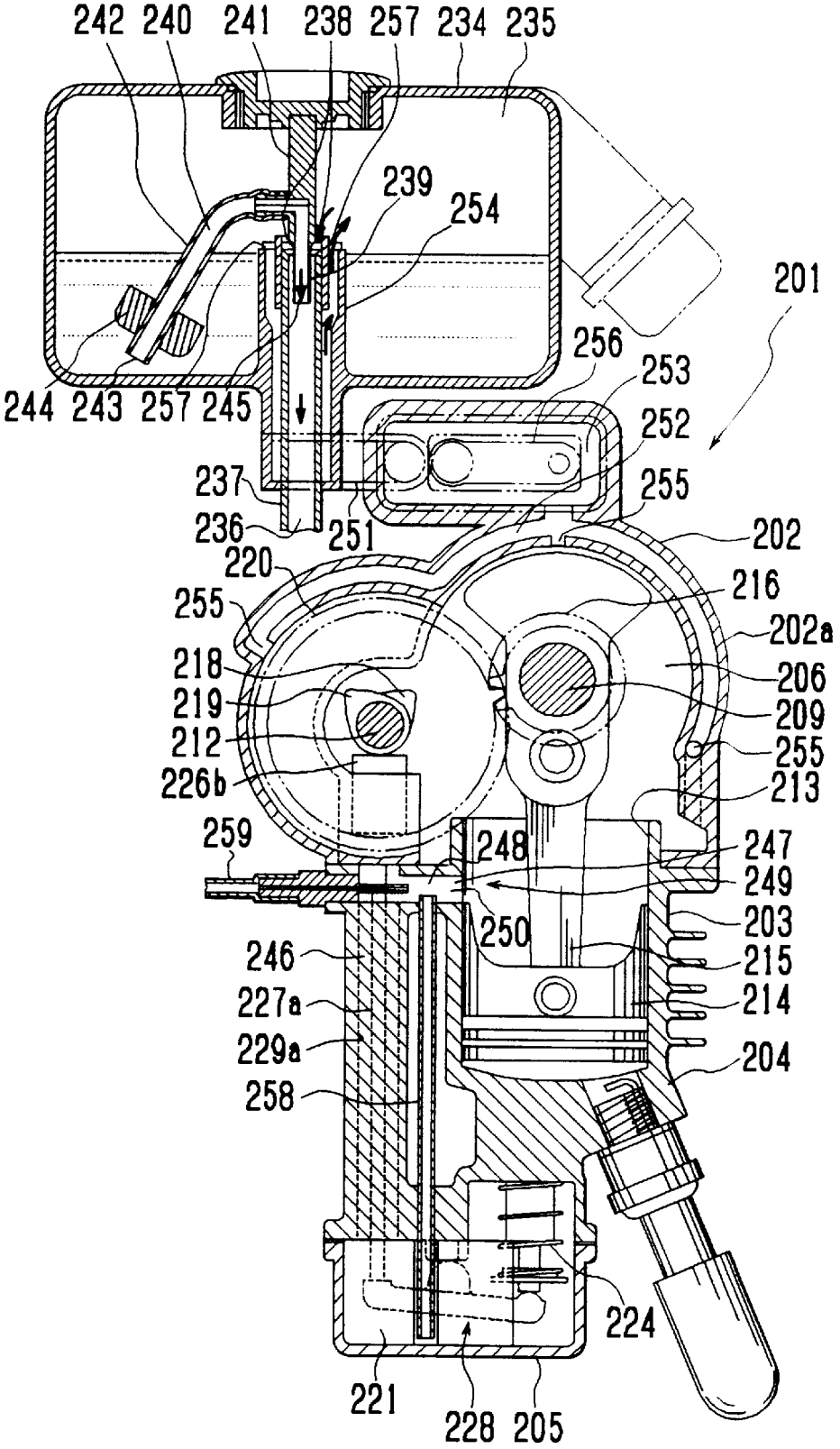
FIG. 21 is a longitudinal sectional front view of the four-stroke-cycle engine positioned upside down.

A seventh embodiment according to the present invention will be explained with reference to FIG. 15 to FIG. 21. FIG. 15 is a longitudinal sectional front view of the four-stroke-cycle engine for use on a portable work machine. FIG. 16 is a sectional view taken along the line VI—VI in FIG. 15. FIG. 17 is a sectional view taken along the line VII—VII in FIG. 15. FIG. 18 is a sectional view taken along the line VIII—VIII in FIG. 15. FIG. 19 is an enlarged longitudinal sectional front view around an oil tank. FIG. 20(A) is a sectional view taken along the line IX—IX in FIG. 19. FIG. 20(B) is a sectional view taken along the line X—X in FIG. 19. FIG. 21 is a longitudinal sectional front view of the four-stroke-cycle engine positioned upside down.

A cylinder block 203 is attached on the upper part of a crank case 202. A cylinder head 204 is mounted on the cylinder block 203. A rocker cover 205 is mounted on the upper part of the cylinder head 204. The crank case 202 is formed by a casing 202*a* and a crank case cover 202*b* attached to a side face of the casing 202*a*. A crank chamber 206 is formed by the surrounding structure of the casing 202*a* and the crank case cover 202*b*.

In the crank chamber 206 the crank shaft 209 supported at both ends on bearings 207 and 208 and cam shaft 212 supported at one end on bearing 210 formed with the casing 202*a* and at another end on bearing 211 formed with the crank case cover 202*b* are rotatably provided. On the crank shaft 209 is connected a piston 214 reciprocated in a cylinder 213 formed in the cylinder block 203. The piston 214 is connected to the crank shaft 209 via a connecting rod 215. A crank gear 216 is also installed on the crank shaft 209. Both ends of the crank shaft 209 penetrates through the casing 202*a* and the crank case cover 202*b* and stick out of them. At the portions where the crank shaft 209 penetrates through the casing 202*a* and the crank case cover 202*b* there are provided oil seals 217. On the cam shaft 212 are fixedly mounted an inlet cam 218 and an outlet cam 219 and also fixedly mounted on the cam shaft 212 us a cam gear 220 meshed with the crank gear 216.

The space covered with the rocker cover 205 above the cylinder head 204 serves as a valve chamber 221, within which a valve mechanism 228 is housed. The valve mechanism 228 comprising: an inlet valve 222 and an outlet valve 223 attached to the cylinder head 204, springs 224 for pressing the inlet valve 222 and the outlet valve 223 toward closing, rocker arms 225 for pressing the inlet valve 222 and the outlet valve 223 toward opening, and push rods 227*a* and 227*b* with one end to be contacted with the rocker arm 225 and another end to be contacted with the inlet cam 218 and the outlet cam 219 via tappets 226*a* and 226*b*. In the cylinder block 203 and the cylinder head 204 are formed push rod passages 229*a* and 229*b* in which the push rods 227*a* and 227*b* are housed. One end of each of the push rod passages 229*a* and 229*b* is connected to the valve chamber 221. The push rod passages 229*a* and 229*b* are separated from each other.

In the cylinder head 204 are formed an inlet port 230 for supplying a mixture to a combustion chamber provided in the cylinder 213 and an outlet port 231 for exhausting exhaust gases from the combustion chamber. A carburetor 232 and an air cleaner (not shown) are connected with the end of the inlet port 230. A muffler 233 is connected with the end of the outlet port 231.

On the lower part of the crank case 202 an oil tank 234 is attached. The oil tank 234 contains an oil chamber 235 for reserving the lubricating oil. The oil chamber 235 and the valve chamber 221 are connected by an oil supply passage 236 for supplying the oil from the oil chamber 235 into the valve chamber 221. The oil supply passage 236 is composed of an oil supply pipe 237 inserted at one end into the oil chamber 235 and connected at another end to the push rod passage 229*b*. The end of the oil supply pipe 237 inserted in the oil chamber 235 is disposed at a center of the oil chamber 235. At the end of the oil supply pipe 237 is formed an air inhalation vent 238 for inhaling the air existing in the oil chamber 235. In the oil supply pipe 237 adjacent to the air inhalation vent 238 there is provided a restrictor 239 having a small-sized diameter in the oil supply pipe 237.

In the oil chamber 235 there is provided an oil inhalation passage 240. The oil inhalation passage 240 is composed of an oil inlet pipe 241 rotatably attached with the end of the oil supply pipe 237 with a certain space to the inner surface of the oil supply pipe 237, and at another end attached to an elastic pipe 242 connected with the oil inlet pipe 241, having elastic characteristics. At the end of the elastic pipe 242 is formed an oil inlet 243. Around the oil inlet 243 there is attached a weight 244 on the elastic pipe 242. The weight 244 contributes to ensure that the elastic pipe 242 is bent according to a tilt of the oil tank 234 so that the oil inlet 243 is always positioned at the lower part in the oil chamber 235. At another end of the elastic pipe 242 there is provided an oil outlet 245 facing the restrictor 239.

Between the valve chamber 221 and the crank chamber 206 there is provided an oil feed passage 246 for feeding the oil supplied to the valve chamber 221 to the crank chamber 206. The oil feed passage 246 is composed of the push rod passage 229*a*, and a passage 248 formed in the cylinder block 203 and connected at one end with the push rod passage 229*a* and connected at another end with the crank chamber 206 via a vent 247. The vent 247 is opened and shut according to the reciprocation of the piston 214 and opened when the piston 214 goes upward to a top dead point. The vent 247 and the piston 214 form a check valve 249 which allows the oil to feed from the valve chamber 221 into the crank chamber 206. Adjacent to the vent 247 of the passage 248 there is provided a restrictor 250 for restricting the air flow in the passage 248.

Between the crank chamber 206 and the oil chamber 235 there is provided a return passage 251 for returning the oil from the crank chamber 206 into the oil chamber 235. The return passage 251 is composed of a ditch-like passage 252 formed in the crank case 202 along the rotating direction of the crank shaft 209, a fork passage 253 forked from the ditch-like passage 252, and a return pipe 254 connected at one end with the fork passage 253 and inserted at another end into the oil chamber 235. The ditch-like passage 252 is connected with the crank chamber 206 by three return vents 255. Between the ditch-like passage 252 and the fork passage 253 there is provided a lead valve 256, which is opened and shut according to the pressure fluctuation in the crank chamber 206, and for allowing the oil to feed from the crank chamber 206 into the oil chamber 235.

The end of the return pipe 254 inserted into the oil chamber 235 is disposed at the center of the oil chamber 235. At the end of the return pipe 254 there is formed a return vent 257 for returning the oil into the oil chamber 235.

A bypass pipe 258 is inserted into the cylinder block 203 and the cylinder head 204. The bypass pipe 258 is connected at one end to the ceiling of the valve chamber 221 and is faced at another end to the restrictor 250.

There is provided a blowby gas exhaust pipe 259 for exhausting blowby gases. The blowby gas exhaust pipe 259 is faced at one end to the restrictor 250 and is connected at another end to the air cleaner which is not shown.

Further, there are provided four flanges 260 facing the end of the return passage 251 positioned in the oil chamber 235, that is, the return vent 257 provided at one end of the return pipe 254. These flanges 260 are formed so as to sticking out from the outer peripheral of the oil inlet pipe 241 in the radial direction as shown in FIG. 20(*b*).

During operation of the four-stroke cycle engine, on the upward stroke of the piston 214, the negative pressure is built up in the crank chamber 206. When the piston 214 reaches the top dead point and the negative pressure in the crank chamber 206 becomes highest, the check valve 249 is opened and the vent 247 is also opened. Then, the oil from the valve chamber 221 is fed into the crank chamber 206 through the oil feed passage 246 with gases from the valve chamber 221.

When the positive pressure is built up in the crank chamber 206 in accordance with the downward stroke of the piston 214, the gases with the oil (mixture including blowby gases as described above) are fed into oil chamber 235 through the return passage 251. That is, the gases mixed with the oil in the mist condition and in the liquid condition are fed from the crank chamber 206 into the fork passage 253 through the passage 255 and the ditch-like passage 252, then, the gases including the oil opens the lead valve 256, and then, the gases are fed into the oil chamber 235 through the return pipe 254 and the return vent 257. Thus, the oil in the mist condition and in the liquid condition held in the crank chamber 206 returns to the oil chamber 235 through the return passage 251.

When the gases with the oil from crank chamber 206 are fed into the oil chamber 235 through the return passage 251, the oil from the oil chamber 235 is supplied into the valve chamber 221 and the crank chamber 206. Such oil supply operation will be explained in detail as follows.

When the gases with the oil are fed into the oil chamber 235 through the return vent 257 of the return pipe 254, the pressure in the oil chamber 235 becomes high, so that the gases from the oil chamber 235 are supplied into the oil supply passage 236 through the air inhalation vent 238. The gases inhaled into the air inhalation vent 238 speed up at the restrictor 239, so that the negative pressure is generated around the restrictor 239. Thus, the oil reserved in the oil chamber 235 is inhaled into the oil inlet 243 of the elastic pipe 242, the oil is fed into the oil supply passage 236 through the elastic pipe 242, the oil inlet pipe 241 and the outlet 245. Then, the gases inhaled from air inhalation vent 238 and the oil fed from the oil outlet 245 are mixed, and an oil in the mist condition is generated. The oil in the mist condition is supplied into the valve chamber 221 with gases supplied into the oil supply passage 236 in accordance with the increase of the pressure in the oil chamber 235. It, therefore, can be prevented that the oil in the liquid condition is directly supplied into the valve chamber 221 and that the excessive oil is supplied into the valve chamber 221 is also prevented. Then, the oil in the mist condition supplied into the valve chamber 221 is partially liquefied in the valve chamber 221, when the pressure becomes low in the crank chamber 206 according to the reciprocation of the piston 214 and the vent 247 is opened, the oil in the mist condition and the liquid condition flow from the valve chamber 221 into the crank chamber 206. Herein, the oil supply means for inhaling the oil from the oil chamber 235 into the inner parts of the four-stroke-cycle engine are operated. The oil supply means supplies the oil from the oil chamber 235 into the inner parts of the four-stroke-cycle engine in accordance with pressure fluctuations generated by the reciprocation of the piston 214. It is, therefore, not necessary to provide an oil pump, etc. for supplying the oil from the oil chamber 235 into the inner parts of the engine, thus resulting in the simplification of the structure, reduction of the parts, compactness of the apparatus and lightness of the apparatus.

In the present embodiment, as the oil inhalation passage 240 for transferring the oil from the oil chamber 235 includes connecting the elastic pipe 242 with the oil inlet pipe 241 rotatably supported, and attaching the weight 244 with the elastic pipe 242 adjacent to the oil inlet 243. Thus, the oil inlet 243 is always positioned at a lower part of the oil chamber 235 even when the engine is tilted in any direction, so that the oil can be inhaled into the oil inlet 243 even though the amount of the oil in the oil chamber 235 is reduced. Thus, the oil inlet 243 is always soaked in the oil reserved in the oil chamber 235. Thus, the oil from the oil chamber 235 can be surely fed into the inner parts of the four-stroke-cycle engine even when the engine is tilted in any direction.

When the pressure in the crank chamber 206 becomes high according to the downward motion of the piston 214, the oil in the mist condition and the liquid condition flows from the crank chamber 206 into the oil chamber 235. At the same time, the mixture including the blowby gases and gases and the oil is fed from the return vent 257 provided at the end of the return passage 251. Thus, This mixture runs into the flanges 260 facing the end of the return passage 251, so that the oil inlet pipe 241 is given the upward force when the engine is positioned upside down. Accordingly, the oil inlet pipe 241 is floated or suspended, thus, the rotation thereof is ensured (refer FIG. 21). So, the oil inlet pipe 241 urged by the weight 244 surely rotates, then, the oil inlet 243 is always positioned toward the direction of gravity. Thus, the oil from the oil chamber 235 can be surely fed into the inner parts of the four-stroke-cycle engine even when the engine is tilted in any direction.

When the engine is used upside down for many hours, generally, the oil in the liquid condition would easily remain in the ceiling of the valve chamber 221. However, there is provided the bypass pipe 258 connected at one end to the ceiling the valve chamber 221 and faced at another end to the restrictor 250 adjacent to the vent 247, so when a big negative pressure is generated around the restrictor 250, the oil remaining in the ceiling of the valve chamber 221 is blown up through the bypass pipe 258 by the negative pressure generated at the restrictor 250, then, the oil is fed into the crank chamber 206. It, therefore, can be prevented that excessive oil remains in the valve chamber 221 even when the engine is operated upside down for many hours.

The oil in the mist condition is generated by providing the air inhalation vent 238, the restrictor 239 and the oil outlet 245 at the end of the oil supply pipe 237, feeding the oil from the oil outlet 245 and inhaling the gases from the air inhalation vent 238 using pressure fluctuations in the crank chamber 206, and mixing the oil within the gases sped up at the restrictor 239. Accordingly, it is easy to generate the oil in the mist condition. In addition, the engine power does not decrease due to generating the oil in the mist condition.

The oil and gases flowing into the oil chamber 235 through the return passage 251 have a high temperature since the oil and gases were used to lubricate the rotating members and sliding members in the valve chamber 221 and the crank chamber 206. The oil and gases having a high temperature flow into the return pipe 254 overlapped with the oil supply pipe 237, so that the high temperature of the oil and the gases flowing in the return pipe 254 is transferred to the oil supply pipe 237. Thus, the oil in the mist condition supplied into the valve chamber 221 through the oil supply pipe 237 is warmed up, so that warming up of the engine can be shortened even at low temperatures.

In the present embodiment of the four-stroke-cycle engine, the return vent 257 and the air inhalation vent 238 are arranged at the center of the oil chamber 235. The advantages thereof will be explained as follows.

The return vents 257 are disposed at the center of the oil chamber 235, in the oil chamber 235 the oil is reserved in a quantity less than a certain quantity, thus, it can be prevented that the gases from the return vent 257 mix into the oil reserved in the oil chamber 235 and whips the oil surface, so that whipped oil is not be inhaled into the air inhalation vent 238. Consequently, the oil in the mist condition supplied into the valve chamber 221 through the oil supply passage 236 is kept at a constant mist density.

Next, the air inhalation vent 238 is disposed at the center of the oil chamber 235. Thus, in the oil chamber 235 the oil is reserved in a quantity less than a certain quantity, so that the gases can be inhaled from the air inhalation vent 238 even when the four-stroke-cycle engine is tilted in any direction. Accordingly, the oil can be generated in the mist condition and the oil in the mist condition can be supplied into the valve chamber 221 and the crank chamber 206.

The present embodiment is comprised as the above, where the oil inlet 243 is always positioned toward the direction of gravity according to the rotation of the oil inlet pipe 241 and the bending of the elastic pipe 242, which is urged by the weight 244. Thus, the oil from the oil chamber 235 can be surely fed into the inner parts of the four-stroke-cycle engine even when the engine is tilted in any direction. Such effects are realized by the rotating structure of the oil inlet pipe 241 and the oil inlet passage 240 partially formed by the elastic pipe 242 having the elastic characteristics. Accordingly, the simplification of the structure, reduction of the parts, compactness of the apparatus and lightness of the apparatus can be realized.

Figure 22:
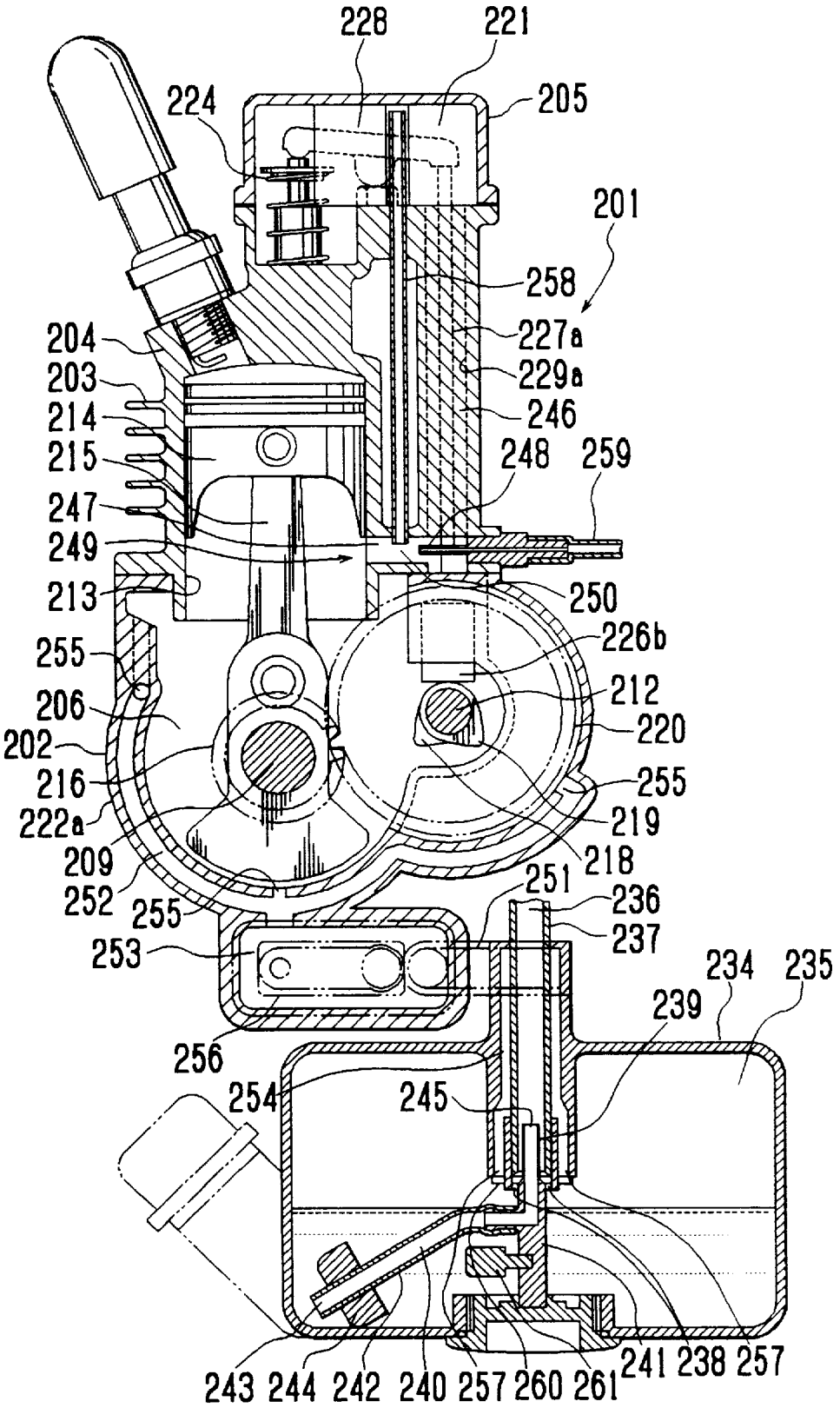
FIG. 22 is a longitudinal sectional front view of a four-stroke-cycle engine in the eighth embodiment according to the present invention.

A eighth embodiment according to the present invention will be explained with reference to FIG. 22. Parts the same as those in the seventh embodiment are designated by the same reference numerals and therefore are not explained herein.

There is provided a second weight 261 on the oil inlet pipe 241. The second weight 261 is positioned so as to be decentered from the axis of rotation of the inlet pipe 241.

In operation, a four-stroke-cycle engine is tilted according to the changing posture of the portable work machine mounted with the engine, where the weight 244 and the second weight 261 rotate the oil inlet pipe 241 and bent the elastic pipe 242. The second weight 261 contributes to the sensitivity at the rotating and bending operation of the oil inlet passage 240 to the effects of gravity. Thus, the second weight 261 urges the oil inlet 243 toward the direction of gravity in response to a slight change of the engine's posture. Accordingly, the oil from the oil chamber 235 can be surely fed into the inner parts of the four-stroke-cycle engine even when the engine is tilted in any direction. Especially, the rotating operation of the oil inlet pipe 241 can be surely accomplished even when the engine is tilted a little, so that the sensitivity of the oil inlet pipe 241 in response to the change of the engine's posture can be realized.

What is claimed is:

1. An oil supply apparatus of a four-stroke-cycle engine, comprising:

an oil tank for holding oil;

a crank case forming a crank chamber, wherein an inside pressure of said crank chamber fluctuates according to movement of a piston;

a valve chamber holding a valve mechanism;

an oil supply passage connecting an inside of said oil tank with said valve chamber;

an oil feed passage connecting said valve chamber with said crank chamber;

a return passage connecting said crank chamber with the inside of said oil tank via a plurality of return vents formed on an inner surface of said crank chamber at substantially equal intervals;

a first check valve disposed at said oil feed passage and allowing feed oil to pass from said valve chamber to said crank chamber;

a second check valve disposed at said return passage and allowing feed oil to pass from said crank chamber to said oil tank;

a restrictor formed in said oil feed passage adjacent to a vent of said oil feed passage connecting with said crank chamber; and a bypass passage connecting said valve chamber with said oil feed passage, wherein one end of said bypass passage opens adjacent to a ceiling of said valve chamber, and another end of said bypass passage opens into a portion facing said restrictor.

2. An oil supply apparatus of a four-stroke-cycle engine as recited in claim 1, wherein said return passage is formed in a wall of said crank chamber.

3. An oil supply apparatus of a four-stroke-cycle engine as recited in claim 1, wherein said return passage is disposed at an outside circumference of said crank case.

4. An oil supply apparatus of a four-stroke-cycle engine as recited in claim 1, wherein two bearings and the oil seals are provided in said crank chamber, said two bearings support a crank shaft, each of said two oil seals are arranged adjacent to said two bearings respectively and seal said crank chamber at penetrating portions of said crank shaft, wherein at least one of said return vents face between said two bearings and said two oil seals.

5. An oil supply apparatus of a four-stroke-cycle engine as recited in claims 1, 2 or 3, wherein said first check valve is formed by said piston and said vent of said oil feed passage, said vent of said oil feed passage is arranged at a position where it is opened and shut by sliding of said piston and it is opened when said piston goes upwards to a top dead point.

6. An oil supply apparatus of a four-stroke-cycle engine as recited in claims 1, 2 or 3, further comprising a blowby gas passage which exhausts blowby gas, said blowby gas passage connected to said oil feed passage so as to face said restrictor at said vent of oil feed passage.

7. An oil supply apparatus of a four-stroke-cycle engine as recited in claims 1, 2 or 3, further comprising a first push rod passage which covers a push rod for driving an inlet valve and a second push rod passage which covers a push rod for driving an exhaust valve, wherein using one of said first and second push rod passages as a part of said oil supply passage and using the other of said first and second push rod passages as a part of said oil feed passage.

8. An oil supply apparatus of a four-stroke-cycle engine as recited in claim 7, further comprising an oil splashier attached to said push rod covered by said push rod passage used as a part of said oil supply passage in said valve chamber.

9. An oil supply apparatus of a four-stroke-cycle engine as recited in claims 1, 2 or 3, further comprising a guide wall formed in said valve chamber, said guide wall leads oil supplied to said valve chamber from said oil supply passage.

10. An oil supply apparatus of a four-stroke-cycle engine as recited in claims 1, 2 or 3, wherein an inlet of said oil supply passage is disposed at a center of said oil tank, and an absorber having permeability is attached to said inlet of oil supply passage.

11. An oil supply apparatus of a four-stroke-cycle engine, comprising:

an oil chamber for holding oil;

an oil supply passage connecting said oil chamber with an inside of said engine, wherein an inside pressure of said engine fluctuates according to movement of a piston, said oil supply passage supplies oil from said oil chamber to said inside of said engine according to pressure fluctuations inside of said engine;

an oil return passage for connecting said oil chamber with the inside of said engine, said oil return passage returns oil from inside of said engine to said oil chamber according to pressure fluctuations inside of said engine;

an air inhalation vent provided in said oil supply passage and disposed at a center of said oil chamber;

a return vent provided in said return passage and disposed at said center of said oil chamber;

a restrictor formed in said oil supply passage for restricting air flow from said air inhalation vent; and an oil inhalation passage providing at one end an oil inlet disposed at a bottom of said oil chamber and at another end an oil outlet at a portion facing said restrictor.

12. An oil supply apparatus of a four-stroke-cycle engine as recited in claim 11, wherein said oil chamber is formed in an oil tank attached to said engine.

13. An oil supply apparatus of a four-stroke-cycle engine as recited in claim 11 or 12, wherein said oil supply passage and said oil return passage are arranged so as to provide thermal conduction between said oil supply passage and said oil return passage.

14. An oil supply apparatus of a four-stroke-cycle engine as recited in claim 11 or 12, further comprising a bypass passage for connecting said oil supply passage with said oil return passage, one end of said bypass passage is connected with said oil supply passage between said restrictor and said air inhalation vent.

15. An oil supply apparatus of a four-stroke-cycle engine, comprising:

an oil chamber for holding oil;

an oil inlet passage including an oil inlet pipe rotatably supported in said oil chamber, and an elastic pipe formed by elastic materials and connected with said oil inlet pipe, said elastic pipe having an oil inlet at one end soaked in oil held in said oil chamber;

a weight attached to said oil inlet passage adjacent to said oil inlet;

an oil supply means connected with said oil inlet pipe for supplying oil to inner parts of the engine from said oil chamber via said oil inlet;

an oil return passage for connecting an inside of said engine with an outer periphery of said oil supply pipe disposed in said oil chamber, wherein said oil return passage returns oil from said inside of said engine to said oil chamber according to pressure fluctuations inside of said engine due to reciprocation of a piston; and a flange attached to said oil supply pipe at a portion facing towards an end of said oil return passage in said oil chamber.

16. An oil supply apparatus of a four-stroke-cycle engine as recited in claim 15, wherein a second weight is attached to said oil inlet pipe so as to be decentered from the axis of rotation of said inlet pipe.

17. An oil supply apparatus of a four-stroke-cycle engine as recited in claim 15, wherein said oil supply means supplies oil from said oil chamber to said inner parts of the engine according to pressure fluctuations inside of said engine due to reciprocation of the piston.

18. An oil supply apparatus of a four-stroke-cycle engine, comprising:

a chamber for holding oil;

an inlet passage including an oil inlet pipe rotatably supported in the chamber, said oil inlet pipe having an inlet at one end soaked in oil held in the chamber;

an oil supply pipe for supplying oil to an inside of the engine from the chamber via the oil inlet pipe;

a return passage, connected between an outer periphery of the oil supply pipe and the inside of the engine, for returning oil from the inside of the engine to the chamber according to oil pressure fluctuations inside of the engine due to reciprocation of a piston; and a flange attached to the oil supply pipe at a portion facing towards an end of the return passage in the chamber;

whereby the inside of the engine is lubricated even when the engine is tilted in any direction.

* * * * *

UNITED STATES PATENT AND TRADEMARK OFFICE

CERTIFICATE OF CORRECTION

PATENT NO. : 5,975,042

DATED : November 2, 1999

INVENTOR(S): Shigemitsu AIZAWA, et al.

It is certified that an error appears in the above-identified patent and that said Letters Patent is hereby corrected as shown below:

On the title page, item [73], should read:

--[73] Assignee: Ishikawajima-Shibaura Machinery Co., Ltd., Tokyo, Japan --

Signed and Sealed this

First Day of August, 2000

*Attest:*

*Attesting Officer*

Q. TODD DICKINSON

*Director of Patents and Trademarks*